US006134418A

United States Patent [19]

Kato et al.

[11] Patent Number: 6,134,418

[45] Date of Patent: Oct. 17, 2000

[54] IMAGE FORMING APPARATUS HAVING A CASING MOUNTED TO THE APPARATUS AT AN UPPER PORTION OF A STACKING DEVICE

[75] Inventors: Yasuhisa Kato, Hiratsuka; Hidenobu Endo, Tokyo; Masaaki Yoshikawa, Sagamihara; Motokazu Yasui, Yokohama, all of Japan

[73] Assignee: Ricoh Company, Ltd., Tokyo, Japan

[21] Appl. No.: 09/353,834

[22] Filed: Jul. 15, 1999

Related U.S. Application Data

[62] Division of application No. 08/814,464, Mar. 10, 1997.

[30] Foreign Application Priority Data

| | | | |
|---|---|---|---|
| Mar. 11, 1996 | [JP] | Japan | 8-53333 |
| Mar. 18, 1996 | [JP] | Japan | 8-61116 |
| Aug. 29, 1996 | [JP] | Japan | 8-228381 |
| Nov. 25, 1996 | [JP] | Japan | 8-313589 |
| Jan. 17, 1997 | [JP] | Japan | 9-6761 |
| Jan. 28, 1997 | [JP] | Japan | 9-13910 |

[51] Int. Cl.[7] ..... G03G 15/00

[52] U.S. Cl. ..... 399/405; 271/207

[58] Field of Search ..... 399/405, 361, 399/381; 271/207, 3.03, 278

[56] References Cited

U.S. PATENT DOCUMENTS

| | | | |
|---|---|---|---|
| 4,300,757 | 11/1981 | Koiso et al. | 271/207 |
| 4,365,887 | 12/1982 | Kakitani et al. | 399/403 X |
| 4,449,813 | 5/1984 | Kikuchi et al. | 399/403 X |
| 4,452,525 | 6/1984 | Ogura . | |
| 4,693,590 | 9/1987 | Umeda | 399/403 X |
| 4,746,111 | 5/1988 | Naramore | 271/287 |
| 4,972,236 | 11/1990 | Hasegawa | 399/361 X |
| 5,105,225 | 4/1992 | Honjo et al. | 399/361 X |
| 5,141,215 | 8/1992 | Ishiguro et al. | 271/287 X |
| 5,400,123 | 3/1995 | Sato et al. . | |
| 5,535,012 | 7/1996 | Matsumoto et al. | 271/287 X |
| 5,655,208 | 8/1997 | Sahay et al. | 399/403 X |

FOREIGN PATENT DOCUMENTS

| | | |
|---|---|---|
| 61-145069 | 7/1986 | Japan . |
| 5-165268 | 7/1993 | Japan . |

*Primary Examiner*—Susan S. Y. Lee

*Attorney, Agent, or Firm*—Oblon, Spivak, McClelland, Maier & Neustadt, P.C.

[57] ABSTRACT

An image forming apparatus of the type having a sheet discharging section provided in an upper portion of a body of the apparatus, a stacking section for stacking a sheet driven out via the sheet discharging section, and a casing accommodating a sheet conveying mechanism. An inclined surface is formed on top of the stacking section and inclines obliquely downward toward the sheet discharge section. A guide on the bottom of the casing is used for sliding against the inclined surface when the casing is mounted to the body of the apparatus.

20 Claims, 36 Drawing Sheets

IMAGE FORMING APPARATUS HAVING A CASING MOUNTED TO THE APPARATUS AT AN UPPER PORTION OF A STACKING DEVICE

This application is a Division of application Ser. No. 08/814,464 Filed on Mar. 10, 1997.

BACKGROUND OF THE INVENTION

The present invention relates to an image forming apparatus having a sheet transport path extending substantially vertically upward from a sheet feed section to a sheet discharge section via an image forming section. More particularly, the present invention is concerned with a printer, facsimile apparatus or similar image forming apparatus allowing a sorter, sorter/stapler, mail box or similar finisher to be readily mounted thereto.

A multifunction image forming apparatus selectively operable as, e.g., a copier, printer or facsimile apparatus is extensively used today. This kind of apparatus has customarily been provided with a constriction based on a copier. Therefore, to use the apparatus as a printer, peripherals for use with the apparatus have each been provided with a mechanism for turning over sheets sequentially output in the order of page. However, the remarkable spread of personal computers is substituting a printer-based configuration for the traditional copier-based configuration. An image forming apparatus eased on a printer is so constructed as to discharge a sheet carrying an image thereon via a sheet discharge section face down by way of a substantially vertically extending sheet transport path. Specifically, the printer-based apparatus has a sheet feed section and the sheet discharge section below and above an image forming section, respectively. The sheet transport path extends substantially vertically from the sheet feed section to the sheet discharge section. While a sheet is conveyed along such a transport path, a toner image is transferred to the sheet. The sheet with the toner image is driven out of the apparatus face down via the sheet discharge section. The substantially vertical transport path is far shorter than the conventional sheet transport path, noticeably reducing the interval between the sheet feed and the sheet discharge. In addition, this path can be almost fully exposed to the outside only if one side of the apparatus is opened, insuring sheet transport and promoting easy removal of a jamming sheet.

However, some problems arise when a sorter, sorter/stapler, mail box or similar finisher is mounted to the apparatus having the substantially vertical transport path. The apparatus has a sheet outlet in its upper portion. Therefore, when a mail box, for example, is mounted to the apparatus, it increases the overall height of the apparatus, and therefore raises the level of a scanner and that of an operation panel, obstructing easy operation. Moreover, mounting a mail box having a number of trays is impractical because the overall height of the apparatus is naturally limited in relation to maneuverability. In addition, the apparatus needs a mechanical strength great enough to bear the weight of the mail box, resulting in an increase in cost.

As stated above, the advantages particular to the substantially vertical transport path cannot be utilized when the above finisher is mounted to the apparatus.

When the finisher is mounted to an image forming apparatus, whether it be provided with the substantially vertical transport path or not, a conveying device for conveying a sheet driven out via the sheet discharge section of the apparatus to the finisher must be mounted to the apparatus. This cannot be done without resorting to exclusive parts and time- and labor-consuming work for mounting the conveying device to the apparatus. In addition, the conveying device increases the number of parts and cost.

There is an increasing demand for an image forming apparatus with a substantially vertical sheet transport path and allowing a plurality of finishers mounted thereto at the same time. However, it is difficult for a plurality of finishers to coexist on a single image forming apparatus. For example, mounting a mail box on the top of the apparatus while mounting a sorter/stapler on the side of the same is not easy. In light of the above, a relay unit having its own sheet transport path and sheet conveying function may be located at the upper portion of the apparatus. The relay unit connects the sheet discharge section to, e.g., a sorter/stapler mounted on the side of the apparatus which does not interfere with, e.g., a mail box mounted on the top of the apparatus. The conveying function as well as a path selecting function available with the relay unit allows the sorter/stapler and mail box to exist together on a single apparatus.

However, the problem with the relay unit is that a sheet jam is apt to occur thereinside due to its own transport path and conveying function. To obviate this kind of sheet jam, the relay unit includes a rotatable cover which may be opened in order to remove a jamming sheet. A portion for effecting usual sheet discharge is constructed integrally with the upstream side of the relay unit. A rotatable cover is also provided in this portion for the removal of a jamming sheet.

The prerequisite with the relay unit is that it be positioned close to the trays of the mail box in order to avoid a noticeable increase in the overall dimensions of the apparatus. This brings about a drawback that when any one of the covers is opened for removing a jamming sheet, the trays of the mail box limit the space available for the removal of the sheet. On the other hand, when an image reading device is mounted on the top of the apparatus, it must be positioned right above the relay unit so as not to raise the level of the operation surface of the device as far as possible. This also makes it difficult to remove a jamming sheet by hand.

SUMMARY OF THE INVENTION

It is therefore an object of the present invention to provide an image forming apparatus making the most of the advantages of a substantially vertical sheet transport path, and allowing a plurality of finishers to be mounted thereto at the same time.

It is another object of the present invention to provide an image forming apparatus having a substantially vertical sheet transport path, making the most of the merits of a relay unit, and allowing a sheet jamming the tray unit or a usual sheet discharge path to be removed with ease.

It is yet another object of the present invention to provide an image forming apparatus having a substantially vertical sheet transport path, and allowing a finisher to be readily mounted thereto.

It is a further object of the present invention to provide an image forming apparatus having a substantially vertical sheet transport path, and eliminating the need for exclusive parts for mounting a finisher thereto.

In accordance with the present invention, an image forming apparatus includes a sheet discharge section provided in the upper portion of the apparatus for allowing a sheet carrying an image thereon and discharged by usual sheet discharge to be stacked on the top of the apparatus via the sheet discharge section. A relay unit extends horizontally on the top of the apparatus, and has a sheet transport path communicable to the sheet discharge section, and a conveying mechanism.

Also, in accordance with the present invention, an image forming apparatus for conveying a sheet substantially vertically from a sheet feed section positioned below an image forming section to a sheet discharge section positioned above the image forming section to thereby form an image on the sheet, and stacking, when the sheet is discharged by usual sheet discharge, the sheet on the top thereof includes a sheet receiving unit located above the sheet discharge section and including at least one tray forming a bin. A relay unit is provided in the upper portion of the apparatus for conveying the sheet driven out via the sheet discharge section to a finisher for finishing the sheet. At least the tray of the sheet receiving unit closest to the relay unit is supported to be rotatable in the up-and-down direction.

Further, in accordance with the present invention, an image forming apparatus for conveying a sheet substantially vertically from a sheet feed section positioned below an image forming section to a sheet discharge section positioned above the image forming section to thereby form an image on the sheet, and stacking, when the sheet is discharged by usual sheet discharge, the sheet on the top of the apparatus includes a sheet receiving unit located above the sheet discharge section and including at least one tray forming a bin. A relay unit is provided in the upper portion of the apparatus, for conveying the sheet driven out via the sheet discharge section to a finisher for finishing the sheet. The relay unit has a transport cover covering the top of the apparatus and divided into a plurality of cover parts in the intended direction of sheet transport. At least one of the cover parts has one end thereof supported by a shaft so as to be rotatable in the up-and-down direction.

Moreover, in accordance with the present invention, an image forming apparatus for conveying a sheet substantially vertically from a sheet feed section positioned below an image forming section to a sheet discharge section positioned above the image forming section to thereby form an image on the sheet, and stacking, when the sheet is discharged by usual sheet discharge, the sheet on the top of the apparatus includes a sheet receiving unit located above the sheet discharge section and including at least one tray forming a bin. A relay unit is provided in the upper portion, of the apparatus for conveying the sheet driven out via the sheet discharge section to a finisher for finishing the sheet. A usual sheet feed section is constructed integrally with the upper portion of the relay unit for discharging the sheet. A discharge cover is included in the usual sheet discharge section and rotatable in the up-and-down direction. The lowest tray of the sheet receiving unit is constructed integrally with the discharge cover.

In addition, in accordance with the present invention, an image forming apparatus includes an image forming section. A sheet feed section and a sheet discharge section are respectively located below and above the image forming section such that a sheet is fed from the sheet feed section to the sheet discharge section substantially vertically via the image forming section to thereby form an image on the sheet. A relay unit extends along the top of the apparatus and communicates the sheet discharge section to a finisher mounted on the apparatus. The relay unit includes a stack section for stacking the sheet driven out via the sheet discharge section, a first conveying device for conveying the sheet driven out via the sheet discharge section to the stacking section, a second conveying device for conveying the sheet to the finisher, a path selecting device for selectively steering the sheet to the first conveying device or to the second conveying device. A controller controls the path selecting device.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
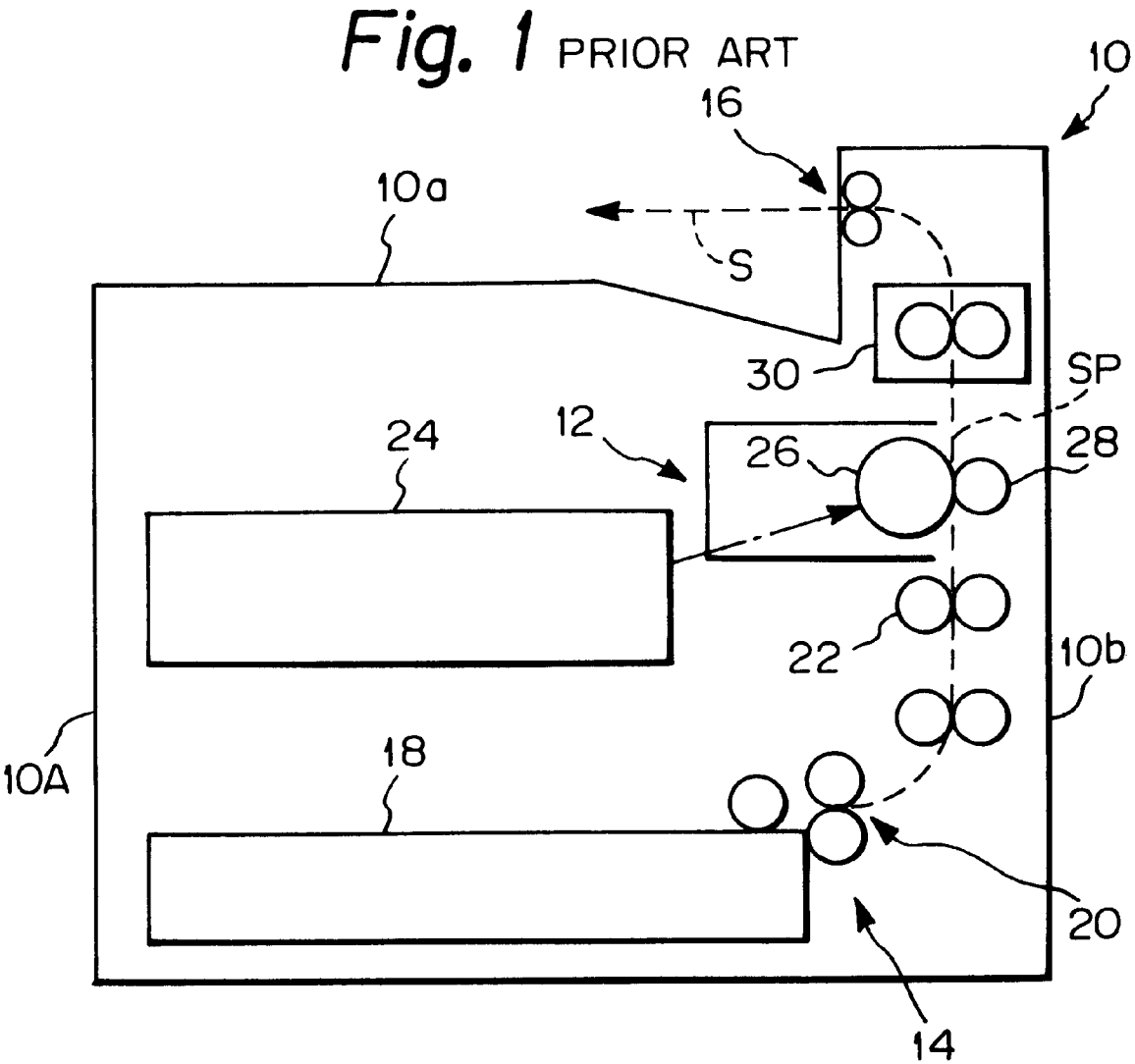
Fig. 1 PRIOR ART
FIGS. 1 and 2 are side elevations each showing a particular conventional image forming apparatus having a substantially vertical sheet transport path.

To better understand the present invention, brief reference will be made to a conventional image forming apparatus including a substantially vertically extending sheet transport path, shown in FIG. 1. As shown, the apparatus, generally 10, includes a body 10A. A sheet feed section 14 and a sheet discharge section 16 are respectively positioned below and above an image forming section 12 in the direction of height of the apparatus body 10A. A sheet transport path SP extends substantially vertically from the sheet feed section 14 to the sheet discharge section 16. The sheet feed section 14 has a tray 18 and a group of feed rollers 20. A sheet S is fed from the tray 18 to a registration roller pair 22 by the feed rollers 20 and conveyor rollers arranged alone the sheet transport path SP. A writing unit 24 forms a toner image on a photoconductive drum 26 in accordance with image data output from a scanner or a personal computer, not shown. The registration roller pair 22 drives the sheet S toward an image transfer position 28 in synchronism with the movement of the toner image carried on the drum 26. At the transfer position 28, the toner image is transferred from the drum 26 to the sheet S. The sheet S with the toner image is conveyed to a fixing unit 30. After the toner image has been fixed on the sheet S by the fixing unit 30, the sheet S is brought to the sheet discharge section 16 and driven out to the top 10*a* of the apparatus body 10A thereby.

The sheet transport path SP is extremely short and reduces the interval between the feed of the sheet S and the discharge of the same while enhancing efficient sheet transport. In addition, the path SP can be almost fully exposed to the outside only if one side 10*b* of the apparatus body 10A is opened, promoting extremely easy removal of a jamming sheet.

However, it is not easy with this kind of apparatus 10 to mount, e.g., a mail box to the top 10*a* or to mount a sorter/stapler or similar finisher to the side, as stated earlier. This will be described with reference to FIG. 2 specifically. As shown, assume that a mail box 32 having, e.g., four bins is mounted to the top 10*a* in a general configuration. Then, the overall height of the system increases. Particularly, when a scanner is mounted in the upper portion of the apparatus 10, the operation surface of the scanner will be located at an extremely high level, rendering the operation difficult. Further, the increase in height of the apparatus naturally limits the number of bins available with the mail box 32 as well as the number of sheets which can be stacked. As a result, only a simple finisher with limited functions is applicable to the apparatus 10.

Figure 2:
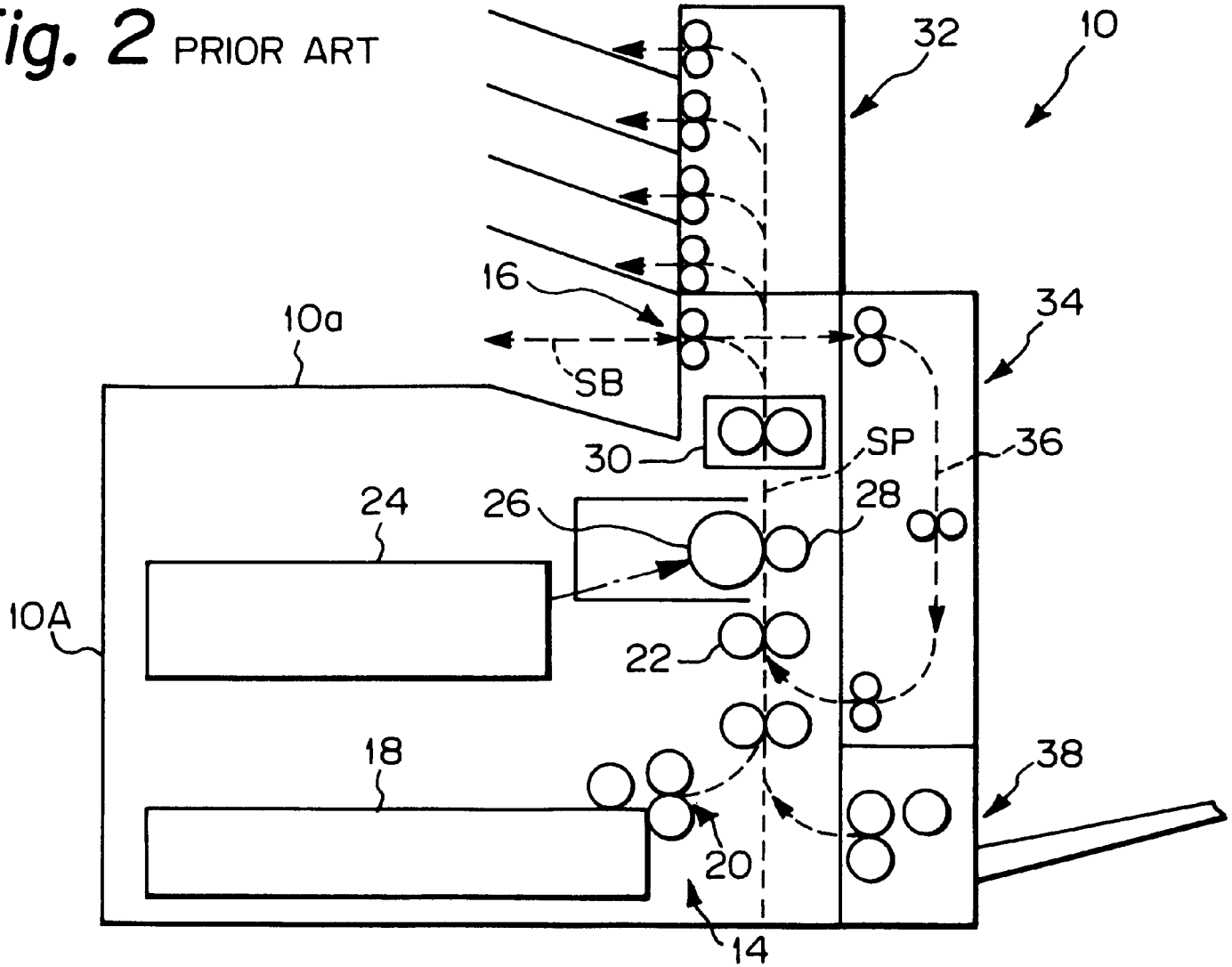
Fig. 2 PRIOR ART

In a duplex copy mode for forming images on both sides of a sheet, the sheet S carrying the toner image on side side thereof, as stated above, is turned, or switched back, in a direction SB by way of the top 10*a* of the apparatus body 10A. Then, the sheet S is routed through a duplex copy path 36 which joins the path SP at a position upstream of the registration roller pair 22. In FIG. 2, the reference numeral 38 designates a manual feed unit for allowing the operator to feed sheets by hand.

Preferred embodiments of the image forming apparatus in accordance with the present invention will be described with reference to the accompanying drawings.

1st Embodiment

Figure 3:
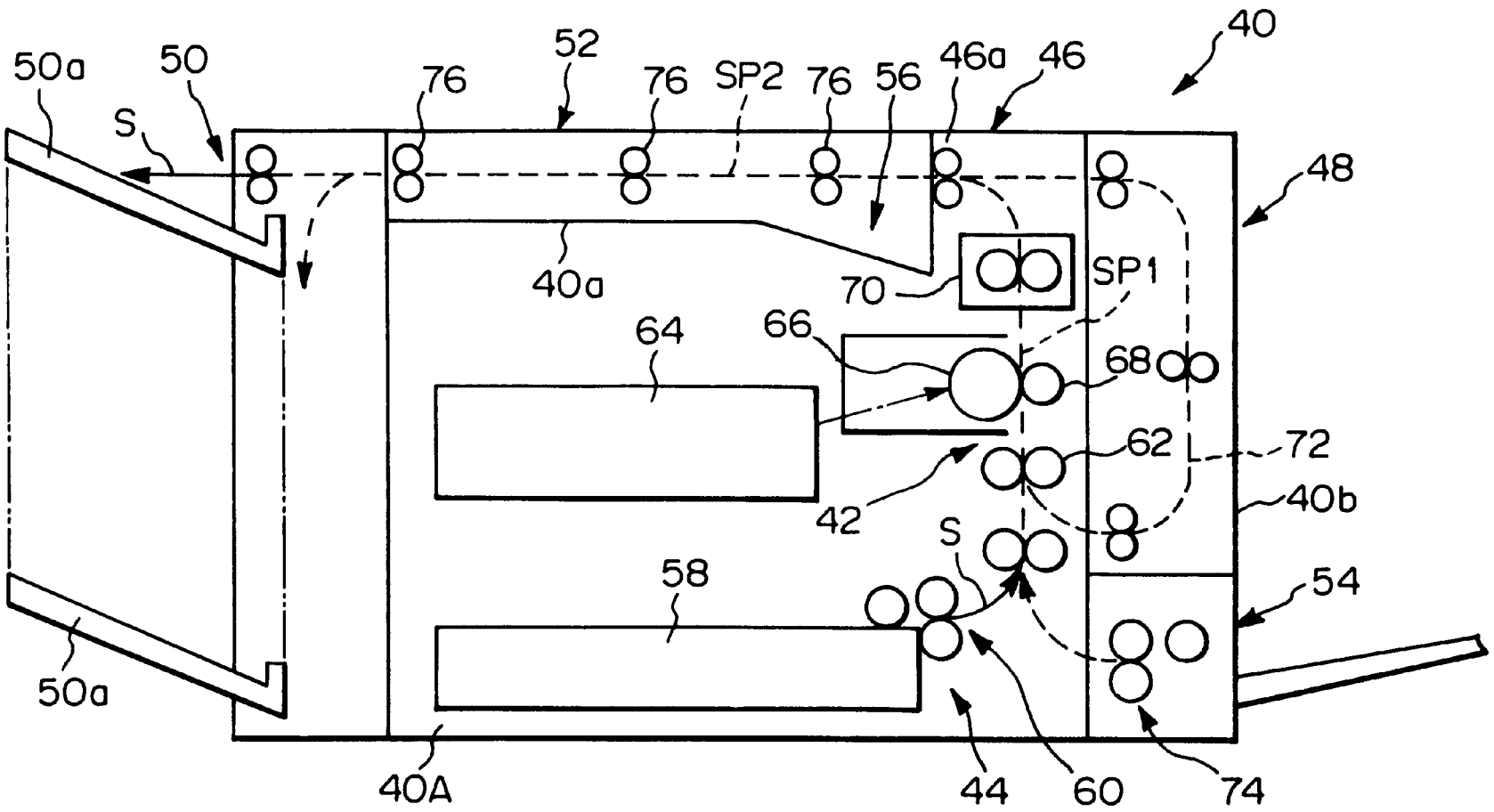
FIG. 3 is a side elevation showing a first embodiment of the image forming apparatus in accordance with the present invention.

Referring to FIG. 3, an image forming apparatus embodying the present invention is shown and generally designated by the reference numeral 40. As shown, the apparatus 40 has a body 40A accommodating a sheet feed section 44 and a sheet discharge section 46 below and above an image forming section 42, respectively. A sheet transport path SP1 extends substantially vertically from the sheet feed section 44 to the sheet discharge section 46. Major process units of the apparatus 42, as well as the sheet feed section 14, are built in the apparatus body 40A. The sheet transport path SP1 is almost fully exposed to the outside only if one side 40*b* of the apparatus 40 is opened.

A duplex copy unit 48 is mounted on the apparatus body 40A in the vicinity of the sheet transport path SP1. A sorter 50 having trays or bins 50 is mounted on the apparatus body 40A at the opposite side to the path SP1. The sorter 50 is a specific form of sheet discharging means or finishing means. A relay unit, or sheet discharging means, 52 is mounted on the top 40*a* of the apparatus body 40A and extends substantially parallel to the top 40*a*. The relay unit 52 communicates a sheet discharge section 46 having a sheet outlet 46*a* to the sorter 50. A manual feed unit 54 is positioned below the duplex copy unit 48.

The duplex copy unit 48, sorter 50 and manual feed unit 54 are distributed to both sides of the apparatus 40, as stated above. This allows the top 40*a* of the apparatus body 40A to be effectively used without obstructing the removal of a jamming sheet from the duplex copy unit 48 or the duplex copying operation.

As FIG. 3 indicates, the major constituents of the apparatus 40 concentrate at one side due to the substantially vertical transport path SP1. Therefore, the central part of the apparatus 40, i.e., the space below the top 40*a* is broad. For this reason, in the illustrative embodiment, the top 40*a* is positioned at a level lower than a preselected level, i.e., the level of a conventional apparatus having major units arranged around its center, while maintaining the discharge section 46 at the conventional level. The relay unit 52 is arranged in a recess 56 between the discharge section 46 and the top 40*a*. The top of the relay unit 52 is flush with the top of the discharge section 46, i.e., the top of the apparatus 40. The sheet outlet 46*a* is substantially aligned with a sheet transport path SP2 defined in the relay unit 52.

As stated above, the relay unit 52 can be arranged while maintaining the discharge section 46 at the conventional level, i.e., without increasing the overall height of the apparatus 40. Because the sheet outlet 46*a* is substantially aligned with the path SP2 of the relay unit 52, the sheet transport distance is minimized.

It is to be noted that the relay unit 52 is similarly applicable even to the apparatus of the type having major units arranged around its center, if desired.

In operation, a sheet fed from a tray 58 included in the sheet feed section 44 by feed rollers 60 is conveyed to a registration roller pair 62 by conveyor rollers, or conveying means, arranged along the path SP1. The registration roller pair 66 drives the sheet S toward an image transfer position 68 in synchronism with the movement of a toner image formed on a photoconductive drum 66, as stated earlier. The toner image is transferred from the drum 66 to the sheet S at the position 68. The sheet S with the toner image is conveyed to a fixing unit 70. After the toner image has been fixed on the sheet S, the sheet S is brought to the sheet discharge section 46.

In a duplex copy mode, the sheet S carrying the toner image on one side thereof is switched back by use of the upper portion of the apparatus body 40A, i.e., the internal structure of the relay unit 52. Then, the sheet S is routed through a duplex copy path 72 joining in the path SP1 at a position upstream of the registration roller pair 62. A sheet fed from the manual feed unit 54 is brought to the path SP1 by a group of rollers 74. The path SP1 of the relay unit 52 is an extension of the path SP1. Conveying means including conveyor rollers 76 is arranged in the relay unit 52. In this sense, the path SP2 is equivalent to the path P1 as to function. The sheet S coming out of the fixing unit 70 is transferred to the sorter 50 by way of the discharge section 46 and relay unit 52.

The relay unit 52 makes it needless to add the sorter 50 or similar finishing device in the direction of height of the apparatus body 40A, promoting the free layout of the finisher. This prevents easy operation from being obstructed by the increase in the height of the apparatus, and obviates the limitations on the number of bins and tie number of sheets to be stacked.

While the illustrative embodiment has concentrated on the sorter 50, it is similarly practicable with a mail box, sorter/stapler or similar finisher.

2nd Embodiment

Figure 4:
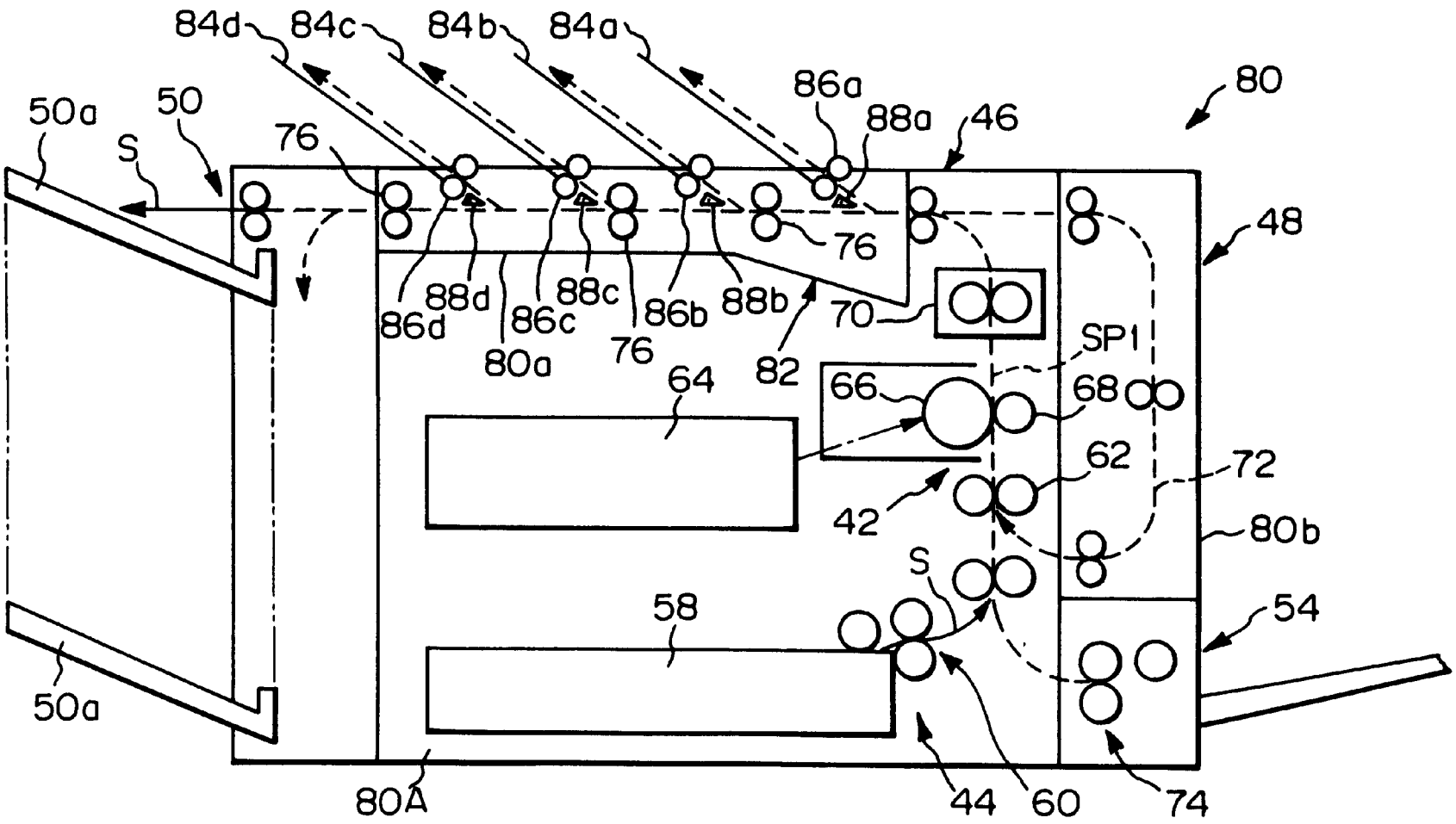
FIG. 4 is a side elevation showing a second embodiment of the present invention.

FIG. 4 shows a second embodiment of the present invention. In this embodiment, the same or similar structural elements as or to the elements of the first embodiment are designated by the same reference numerals, and a detailed description will not be made in order to avoid redundancy. As shown, the second embodiment includes a relay unit 82 having at least one tray, four trays 88*a*–88*d* by way of example. Discharge rollers 86*a*–86*d* and path selectors 88*a*–88*d* are respectively associated with the he trays 83*a*–84*d*. With this configuration, the relay unit 82 plays the role of a mail box, sorter, or similar unit for sorting or stacking sheets. The trays 84*a*–84*d* may be used in combination with the sorter 50 for sorting or stacking sheets sequentially transferred from the sheet discharge section 46.

Figure 5:
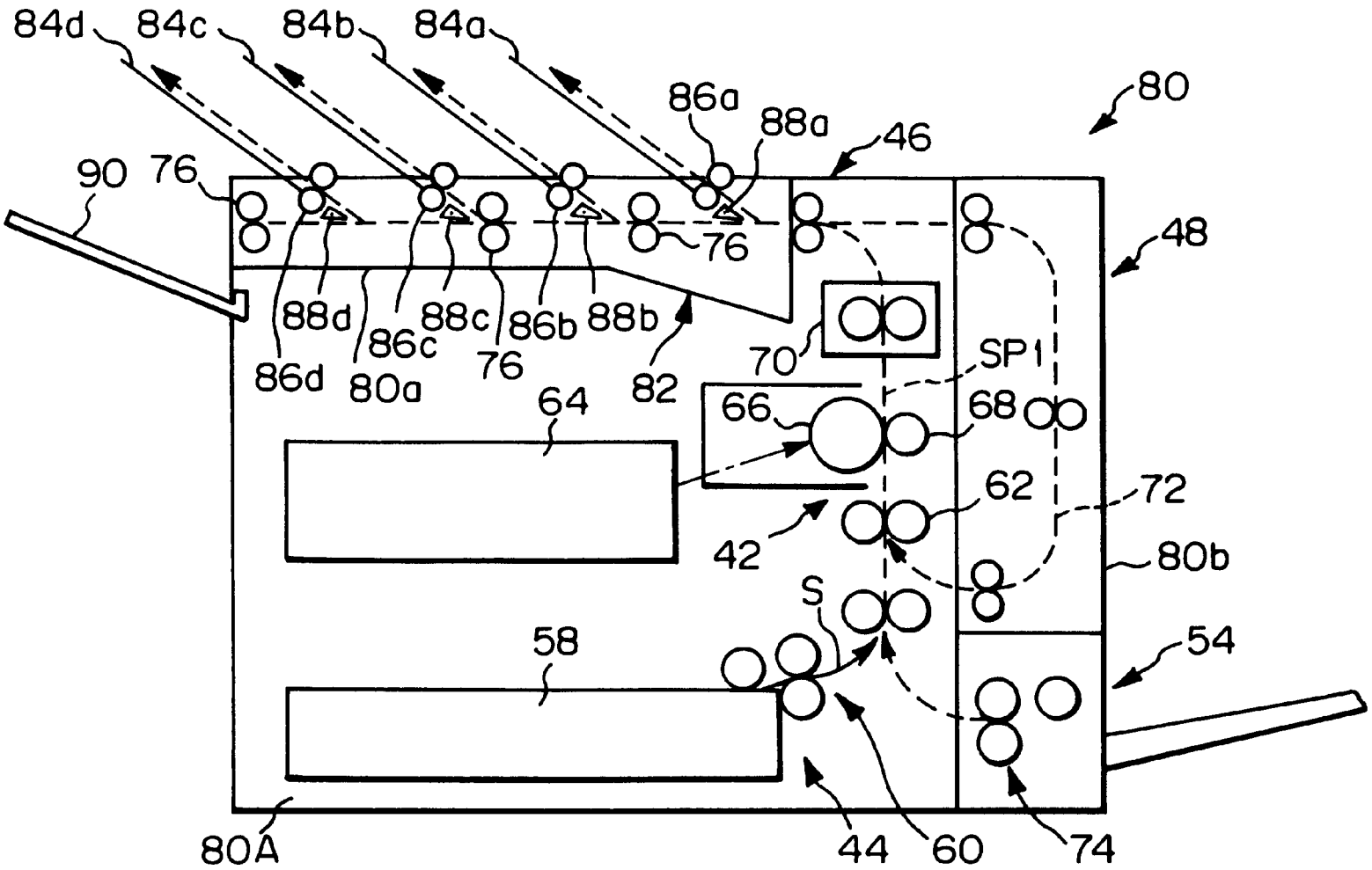
FIGS. 5 and 6 are side elevations each showing a particular modification of the second embodiment.

As shown in FIG. 5, a tray 90 may be positioned downstream of the relay unit 82 with respect to the direction of sheet transport so as to operate in combination with the trays 84*a*–84*d*.

As stated above, the relay unit 82 extending substantially parallel to the top of the apparatus body, labeled 80A, is capable of serving as finishing means alone. Therefore, even when the number of trays is increases, the increase of the height of the apparatus remains constant and is minimized. Further, the relay unit or finishing means 82 can coexist with another or other finishers without increasing the height of the apparatus. In addition, the usual sheet discharge and the sheet discharge to the finisher share a single path, so that the path is simple.

In the embodiment, sheets are usually driven out to the most upstream tray, i.e., tray 84*a* in order to prevent the advantages of the substantially vertically path from being lessened.

Figure 6:
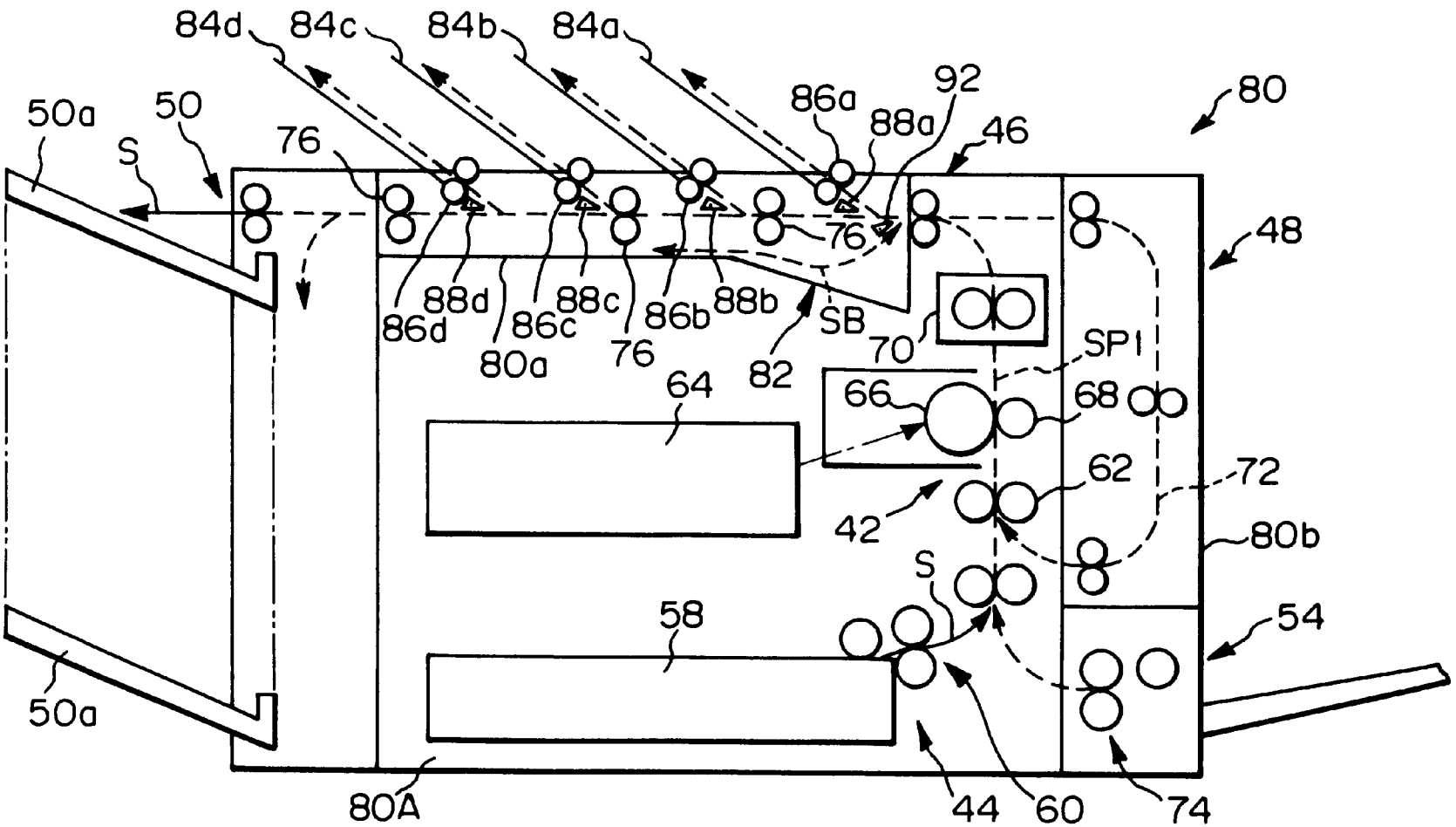

Assume that the first or the second embodiment switches back the sheet within the relay unit 52 or 82 in the duplex copy mode. Then, the entire conveying means arranged in the relay unit 52 or 82 must be provided with a reversible rotating function. Such an arrangement would increase the cost and deteriorate reliability of transport. In light of this, as shown in FIG. 6, path selecting means 92 may be positioned just after the sheet discharge section 46 while another switch-back path may be defined in the relay unit 82. In FIG. 6, the top 80*a* of the apparatus body 80A bifunctions as a tray and a switchback path SB at the same time. This eliminates the need for an additional switch-back path which would complicate the construction.

The first and second embodiments described above have the following unprecedented advantages.

(1) A relay unit is mounted on the top of an apparatus and arranged in the horizontal direction, allowing finisher or the like to be added to the side of the apparatus. The finisher can be added without lessening the advantages of a substantially vertical sheet transport path, e.g., easy removal of a jamming sheet.

(2) The top of the apparatus is so lowered as to accommodate the relay unit in a compact configuration while maintaining a sheet discharge section at the conventional level, taking advantage of the characteristic structure of the substantially vertical path. The relay unit therefore does not increase the dimensions of the apparatus.

(3) A sheet outlet included in the sheet discharge section is substantially aligned with a sheet transport path defined in the relay unit. This minimizes the sheet transport distance to, e.g., finisher.

(4) Because the relay unit is capable of sorting or stacking sheets alone, it can be implemented as finishing means itself and can further enhance a multifunction configuration.

(5) An additional switch-back path is formed in the relay unit and makes it needless for the entire conveying means of the relay unit to have a reversible rotating function.

(6) The switch-back path is implemented by the top of the apparatus playing the role of a tray. Therefore, a sheet can be easily switched back without resorting to any additional construction.

3rd Embodiment

Figure 7:
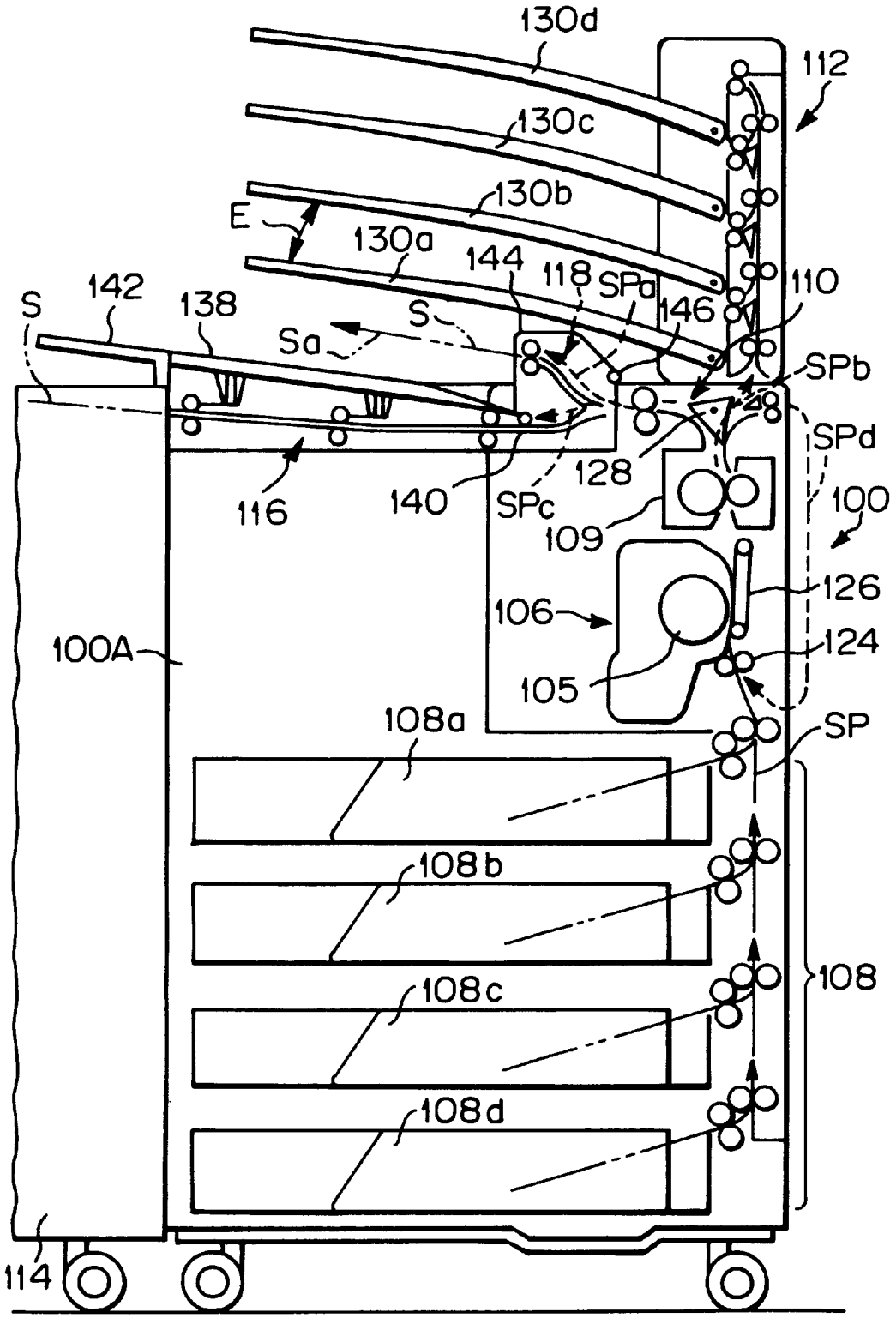
FIG. 7 is a side elevation showing a third embodiment of the present invention.

Reference will be made to FIGS. 7–10 for describing a third embodiment of the present invention. As shown in FIG. 7, an image forming apparatus 100 includes a body 100A accommodating an image forming section 106. The image forming section 106 includes a photoconductive drum 105. A sheet feed section 108 is positioned below the section 106 while a fixing section 109 and a sheet discharge section 110 are positioned above the section 106. A writing unit and other conventional units are not shown because they are not relevant to the understanding of this embodiment. A mail box or sheet receiving means is mounted on the top of the sheet discharge section 110 and has one or more trays. A sorter, sorter/stapler or similar finisher 114 is mounted on one side of the apparatus body 100A in order to deal with sheets coming out of the body 100A. A relay unit 116 is also mounted on the top of the apparatus body 100A and communicates the sheet feed section 110 and finisher 114. A usual sheet discharge section 118 is formed integrally with the relay unit 116. The relay unit 116 plays the role of a single bin or tray and has its own sheet transport path and conveying function arranged thereinside. The sheet feed section 108 has a plurality of cassettes 108*a*–108*d* each storing a stack of sheets 20 of particular size.

The transport path SP extends substantially vertically from the sheet feed section 108 to the sheet discharge section 110 via the image forming section 106. The major process units of the image forming section 106, as well as the sheet feed section 108, are built in the apparatus body 100A. The sheet path SP is almost fully exposed to the outside only if the side of the apparatus body 100A is opened, promoting easy jam processing.

A sheet S of desired size is fed from the sheet feed section 108 to a registration roller pair 124, and therefrom to the image forming section 106. A toner image is transferred from the drum 105 to the sheet S at an image transfer position, not shown. The sheet S with the toner image is conveyed to the fixing unit 109 by a conveyor device 126 arranged along the sheet path SP. The sheet S coming out of the fixing unit 109 is steered to the usual discharge path 118 by, e.g., a path selector 128 (path SPa) and laid on the top of the apparatus body 100A (transport cover 138 which will be described), or steered to the mail box 112 (path SPb), or steered to the relay unit 116 (path SPc). The path SPc terminates at the finisher 114. In the duplex copy mode, the sheet S carrying the image on one side thereof is switched back from the usual sheet feed section 118 into a path SPd formed in a duplex copy unit, not shown. As a result, the sheet S turned upside down is again brought to the path SP.

Figure 8:
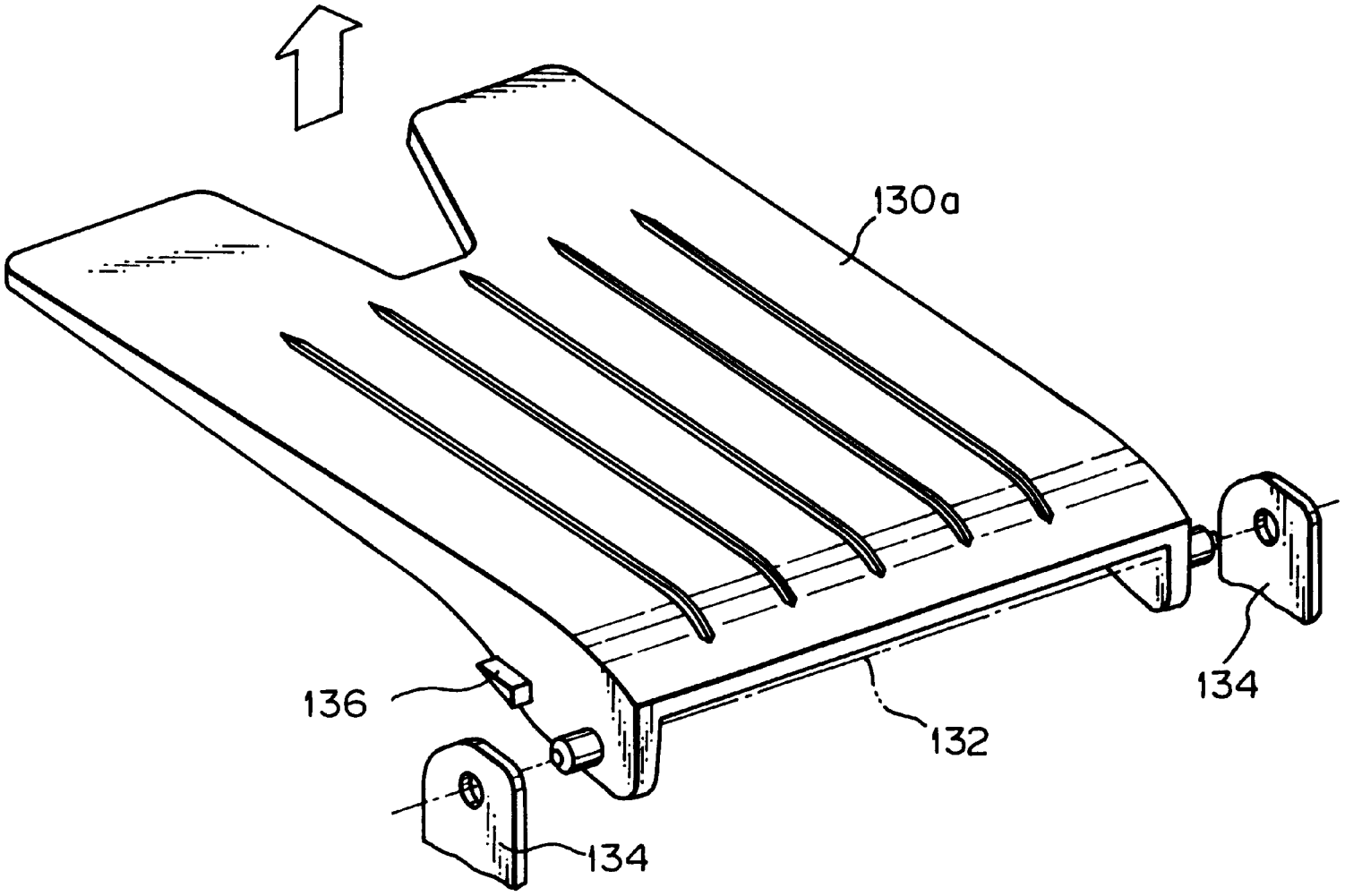
FIG. 8 is a perspective view of a tray included in the third embodiment.

In the illustrative embodiments, the mail box 112 has at least four bins or trays 130*a*–130*d*. At least the tray 130 closest to the relay unit 116 is mounted on the body, not shown, of the mail box 112 in such a manner as to be rotatable up and down (direction E). Specifically, as shown in FIG. 8, the tray 130*a* has a shaft 132 journalled to brackets 134 included in the body of the mail box 112. A stop 136 is affixed to one side of the tray 130*a* adjacent to the shaft 132. When the stop 136 abuts against the bracket 134 adjacent thereto, it limits the downward movement of the tray 130*a* (lower limit).

As shown in FIG. 7, the transport cover 138 mentioned earlier is rotatable up and down about a shaft 140. When the cover 138 is rotated upward, the path SPc is exposed to the outside and facilitates the removal of a jamming sheet. At the same time, the cover 138 plays the role of a tray associated with the usual sheet discharge section 118. An auxiliary tray 142 is contiguous with the outermost end of the cover 138. A discharge cover 144 rotatable up and (down about a shaft 146 is included in the usual discharge section 118. By raising the discharge cover 144, it is possible to uncover the path SPa in order to remove a jamming sheet.

In the embodiment, the mail box or sheet receiving means 112 having one or more trays is mounted on the top of the apparatus body 100A. In this case, to reduce the overall height of the apparatus as far as possible (for easy operation). it is necessary to reduce the space between the top of the apparatus body 100A, i.e.. relay unit 116 and the bottom tray 130*a* of the mail box 112 as far as possible. When the cover 138 of the relay unit 116 is raised or opened, it tray 130*a* interferes with the cover 138.

Figure 9:
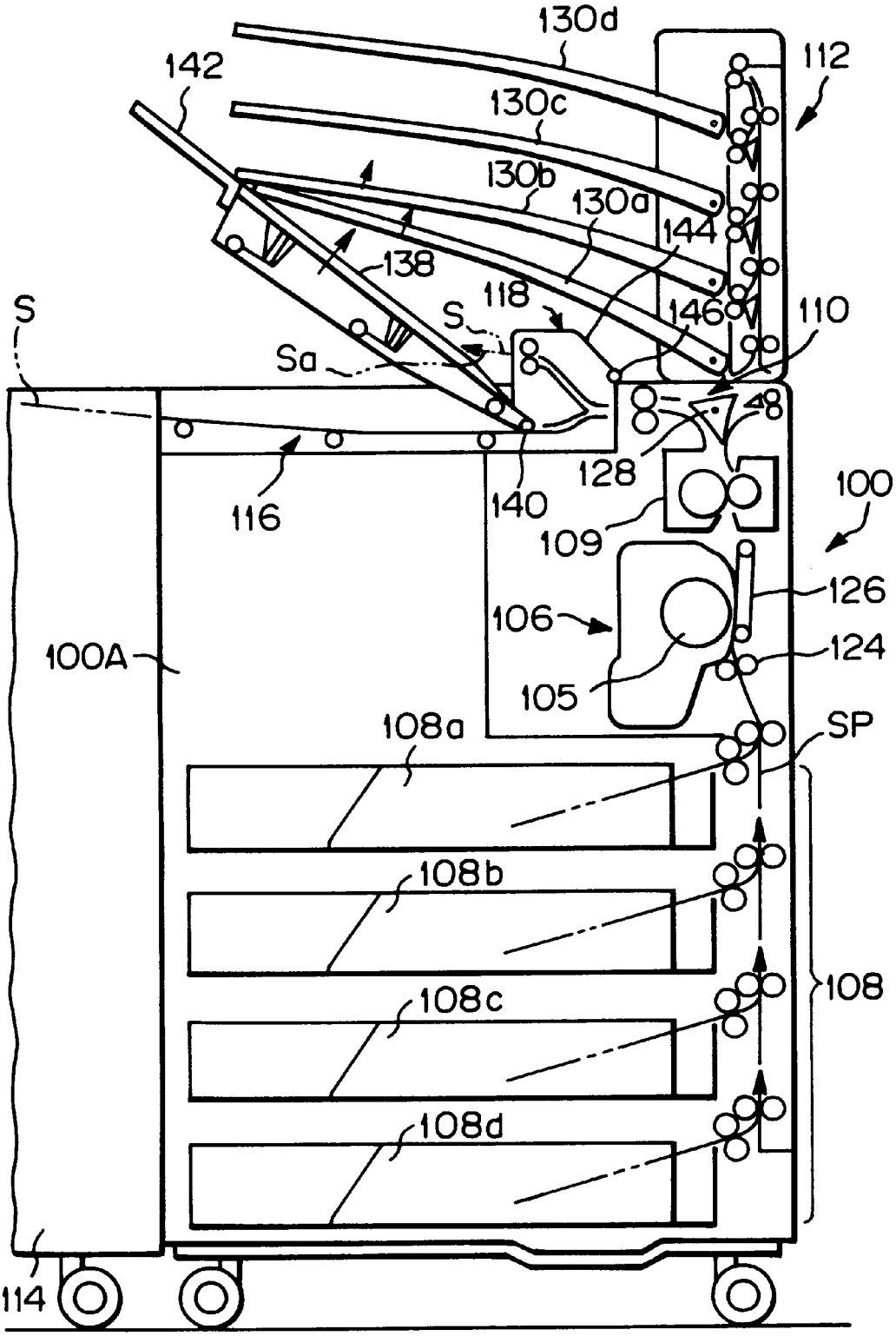
FIG. 9 is a side elevation of a relay unit included in the third embodiment with a transport cover thereof opened.

However, because the tray 130*a* is rotatable up and down, the cover 138 abutting against the tray 130*a* cause the tray 130*a* to rotate upward (retract), as shown in FIG. 9. Consequently, the cover 138 can be sufficiently raised and provides a space broad enough to promote easy removal of a jamming sheet. After the jam processing, only if the cover 138 is lowered, the tray 130*a* is automatically lowered to its preselected position due to its own weight. If the retraction of the tray 130*a* does not suffice, the tray 103*b* overlying the tray 130*a* may also be rotatably supported.

Figure 10:
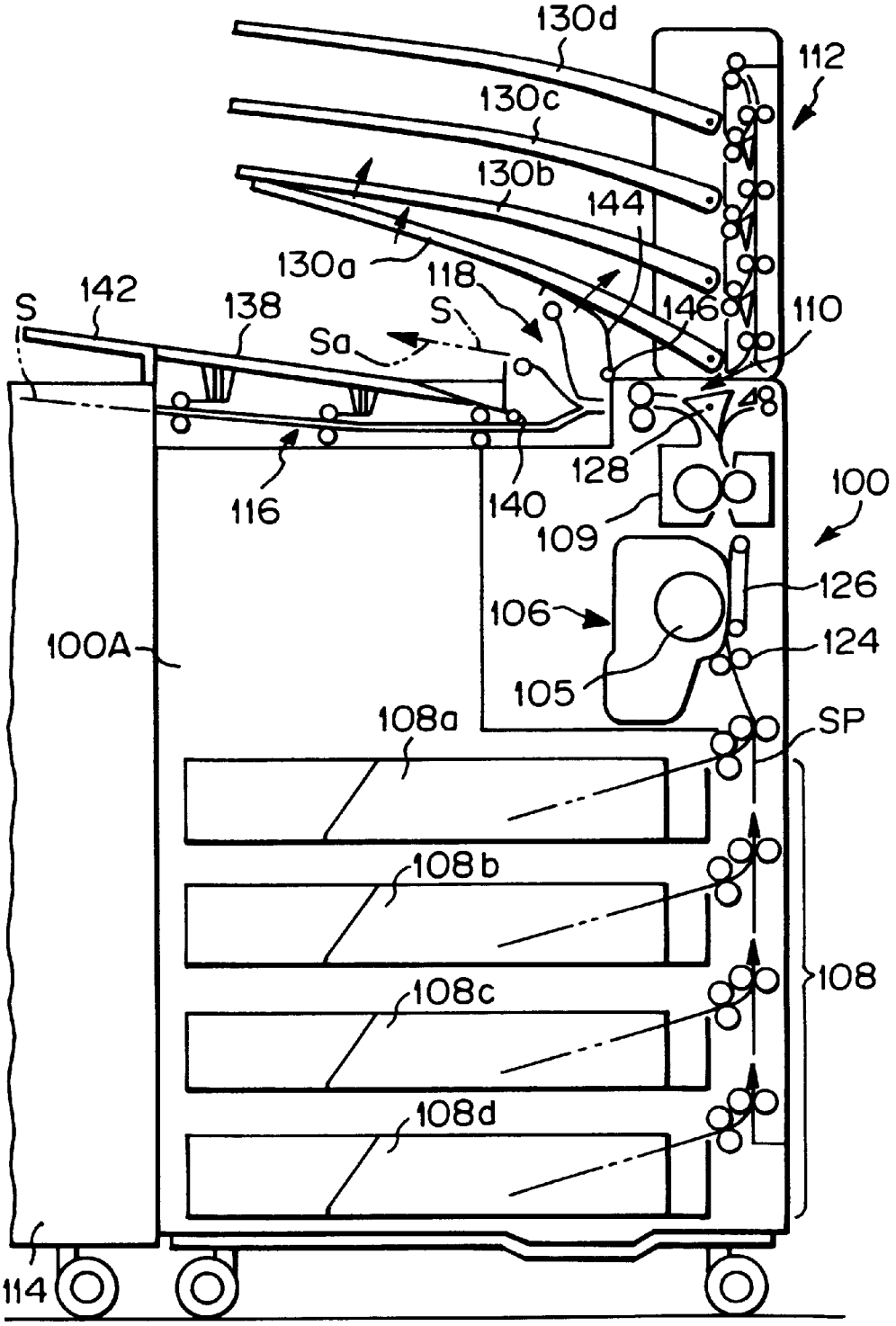
FIG. 10 is a side elevation of the relay unit with a discharge cover thereof opened.

As shown in FIG. 10, when the discharge cover 144 of the usual sheet discharge section 118 is opened for removing a jamming sheet, the tray 130*a* is also raised to form a sufficient working space.

4th Embodiment

Figure 11:
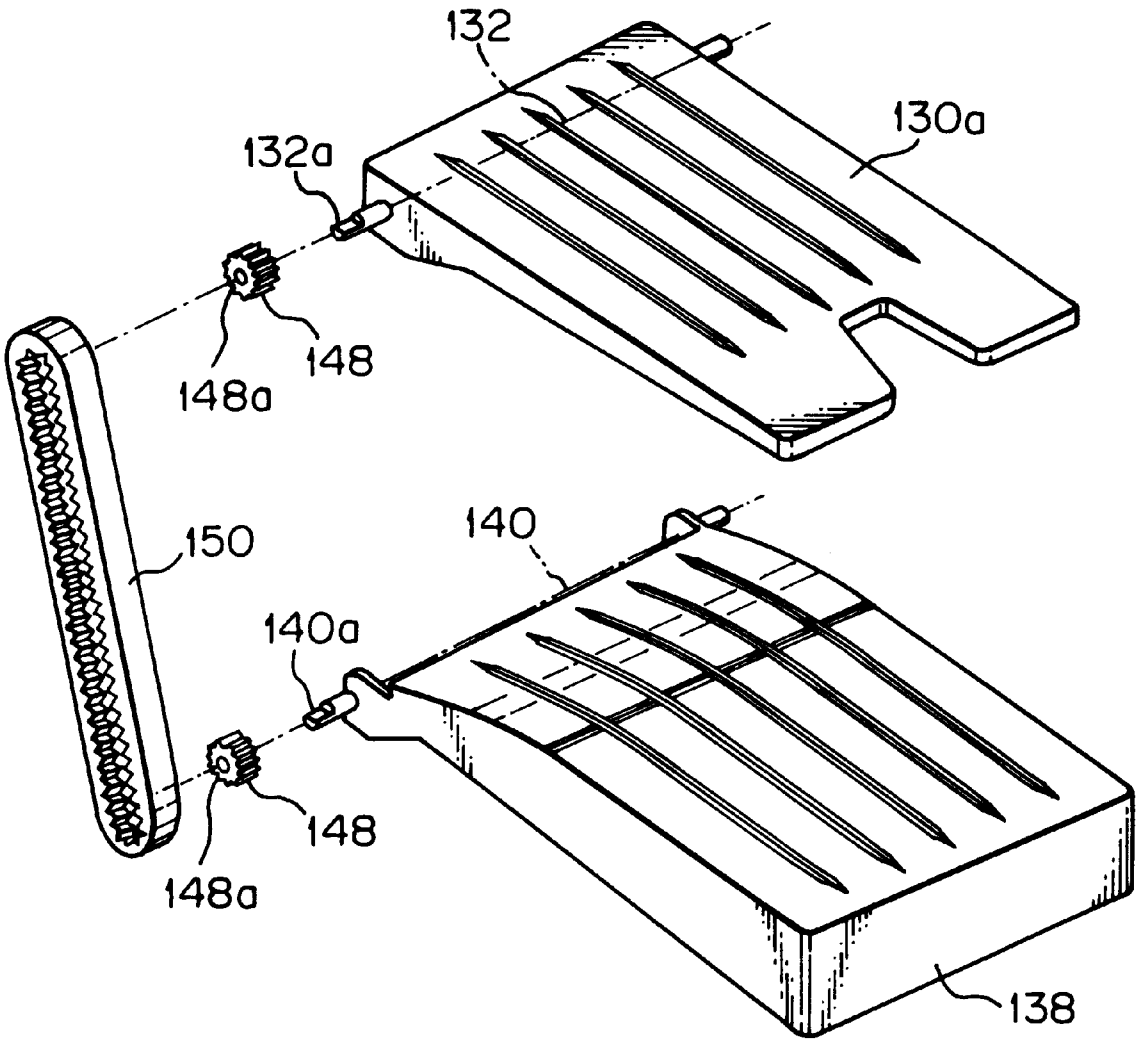
FIG. 11 shows a perspective view of a transport cover and a tray included in a fourth embodiment of the present invention.
Figure 12:
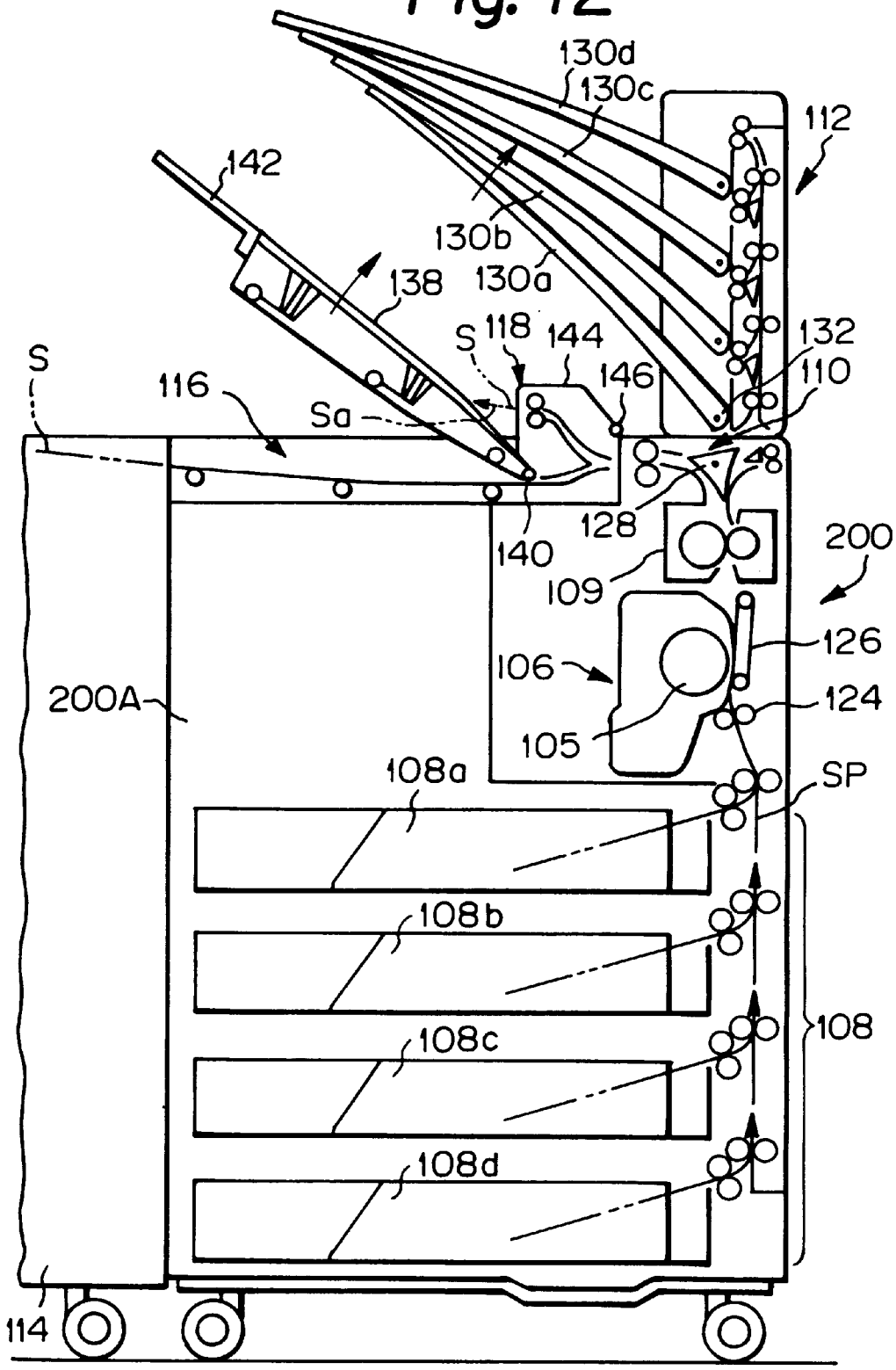
FIG. 12 is a side elevation showing the fourth embodiment with the transport cover opened.

FIGS. 11 and 12 show a fourth embodiment of the present invention. In this embodiment, the same or similar structural elements as or to the elements of the third embodiment are designated by the same reference numerals, and a detailed description thereof will not be described in order to avoid redundancy. As shown, an image forming apparatus 200 is characterized in that the tray 130*a* is rotatable in synchronism with the transport cover 138. Specifically, the shaft 132 of the tray 130*a* has one end thereof removed, as at 132*a*. A toothed pulley 148 has a hole 148*a* identical in cross-section as the removed portion 132*a* of the shaft 132, and is affixed to the removed portion 132*a*. Likewise, a toothed pulley 148 is affixed to a removed portion 140*a* included in the shaft 140 of the transport cover 138. A timing belt 150 having a toothed inner periphery is passed over the toothed pulleys 148. The trays other than the tray 130*a* are freely rotatable, as in the third embodiment.

As shown in FIG. 12, when the cover 138 of the relay unit 116 is opened, the tray 130*a* is also rotated upward via the timing belt 150. As a result, a sufficient working space is available above the cover transport 138, facilitating the removal of a jamming sheet. In addition, because the tray 130*a* does not abut against the cover 138, it is not necessary for the operator to raise the tray 130*a*.

If desired, the discharge cover 144 and tray 130 may be interlocked in the same manner as he transport cover 138 and tray 130*a*. Alternatively an arrangement may be made such that when one of the covers 138 and 144 is opened, the tray 130*a* rotates in interlocked relation thereto. The toothed pulleys 148 and timing belt 150 may be replaced with a gear and rack device, linkage, etc.

5th Embodiment

Figure 13:
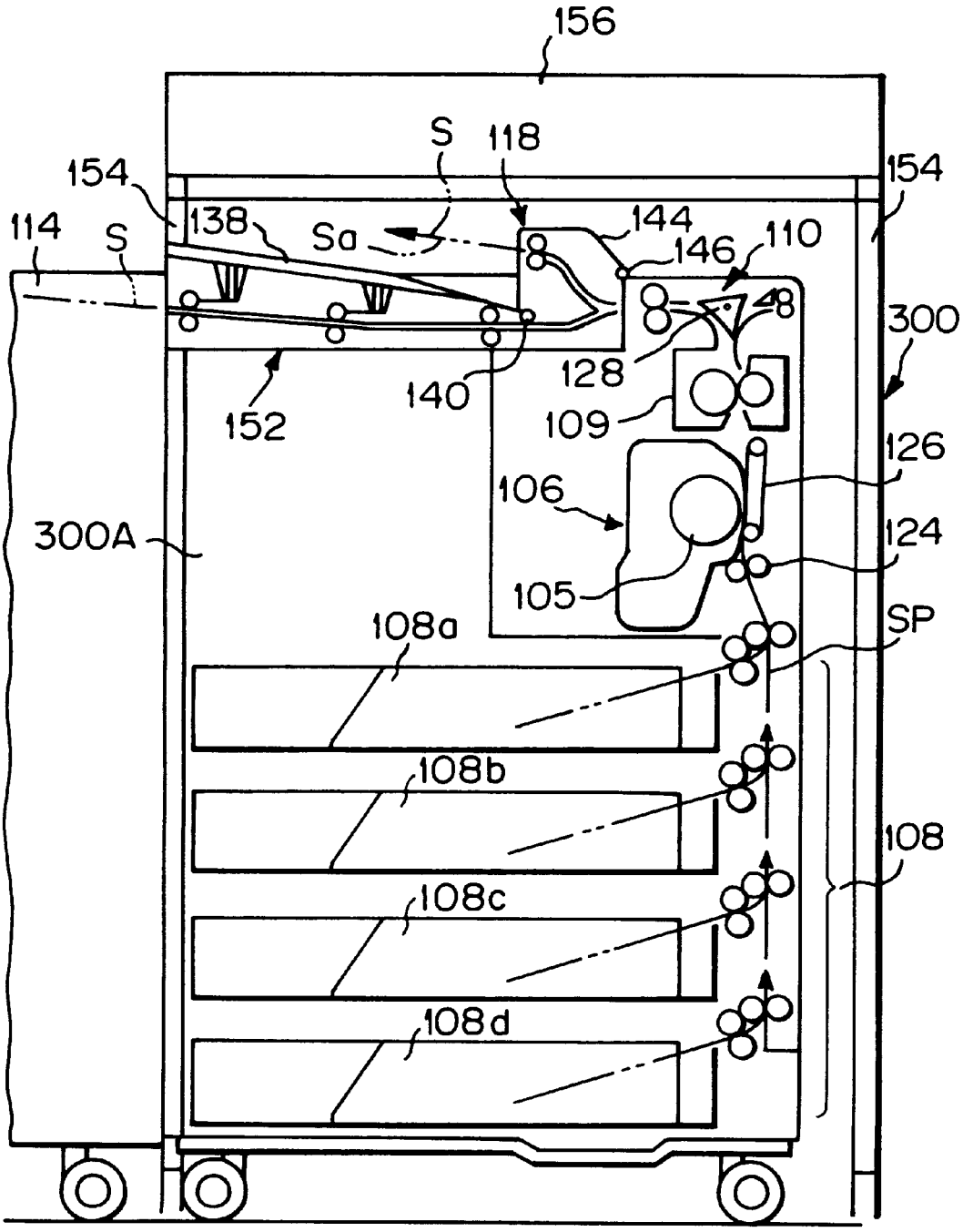
FIG. 13 is a side elevation showing a fifth embodiment of the present invention.

Reference will be made to FIGS. 13–17 for describing a fifth embodiment of the present invention. In this embodiment, the same or similar structural elements as or to the elements of the third and fourth embodiments are designated by the same reference numerals, and a detailed description thereof will not be made in order to avoid redundancy. As shown in FIG. 13, an image forming apparatus 300 includes a movable relay unit 152 mounted on the top thereof. The usual sheet discharge section 118 is formed integrally with the tray unit 152. A scanner or image reading device 156 is mounted on the apparatus 300 above the relay unit 152 by a frame 154. The space between the relay unit 152 and the scanner 156 is reduced as far as possible in order to prevent the operation surface of the scanner 156 from being increased in level.

Figure 14:
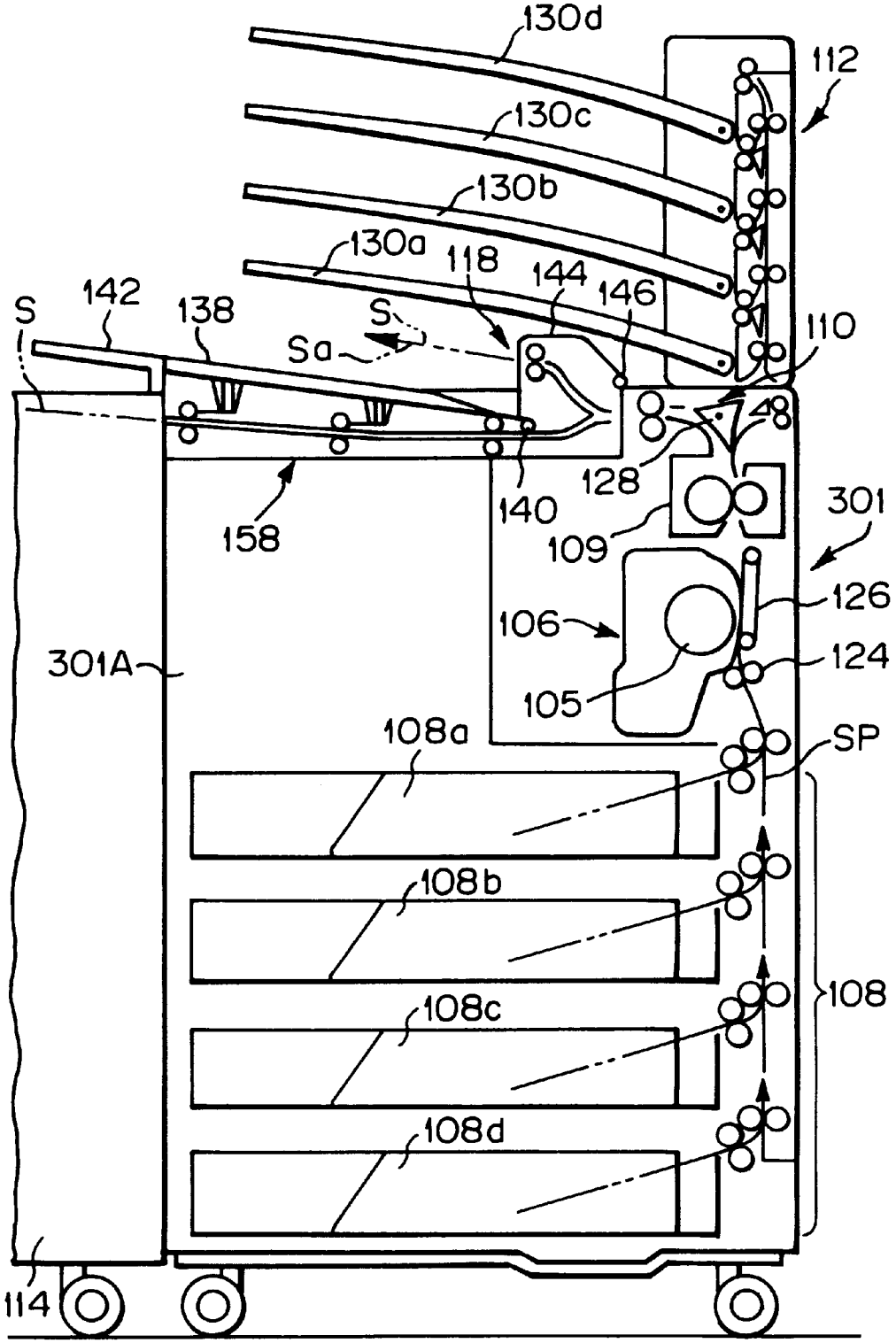
FIG. 14 is a side elevation showing a mail box located above a relay unit of the fifth embodiment.

FIG. 14 shows another image forming apparatus 301 also representative of the illustrative embodiment. As shown, a relay unit 158 having the usual sheet discharge section 118 integrally therewith is mounted on the top of the apparatus 301. The mail box 112 having four bins or trays is positioned above the sheet discharge section 110. In this embodiment, the tray 130*a* is not rotatable.

Figure 15:
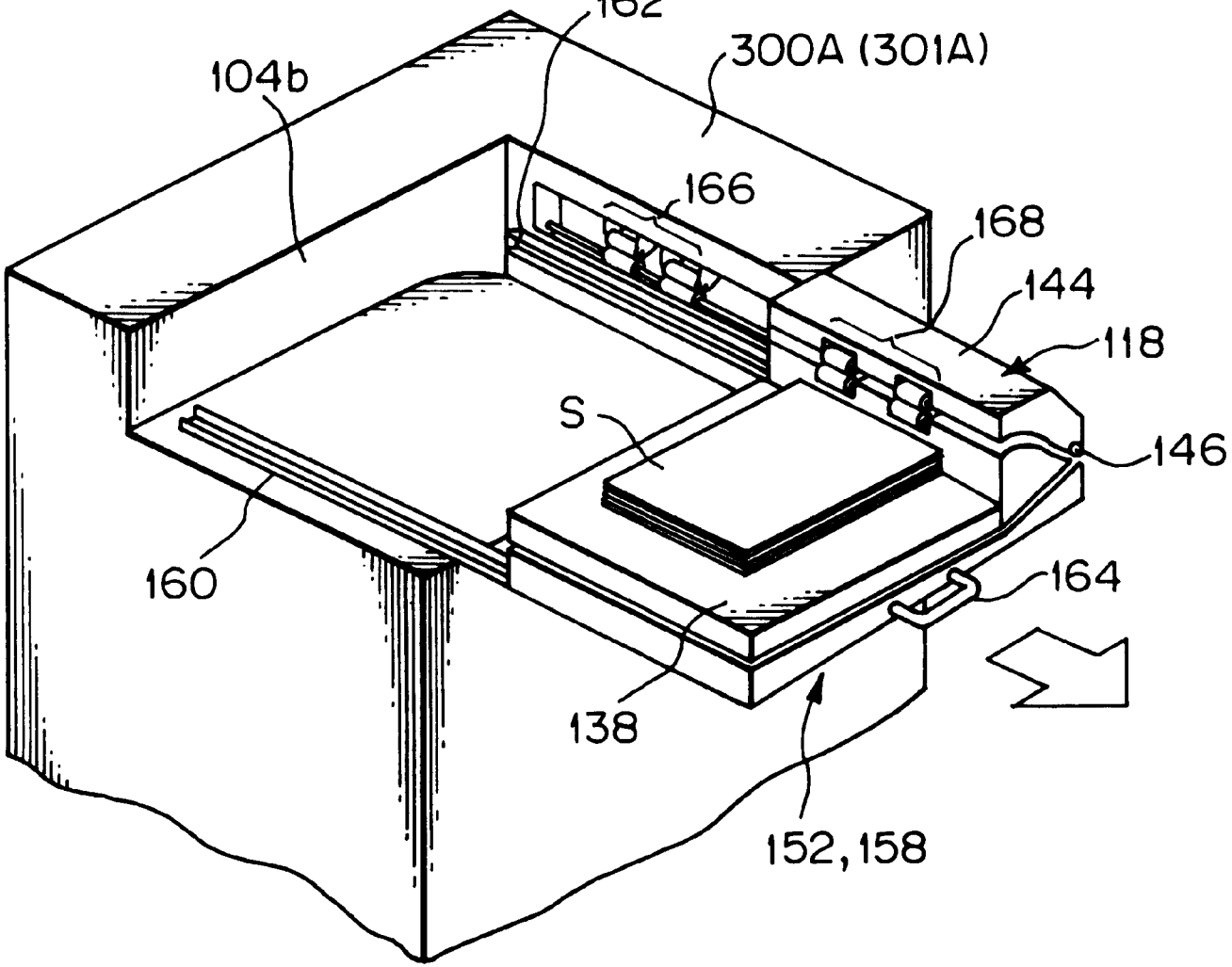
FIG. 15 is a perspective view showing the relay unit of the fifth embodiment pulled out from the body of the apparatus.

As shown in FIG. 15, the movable relay unit 152 or 158 (partly omitted) is slidably supported by guide rails 160 and 162. The guide rail 160 is affixed to the bottom of a recess 104*b* located at the top of an apparatus body 300A or 301A while the guide rail 162 is affixed to one side wall of the recess 104*b*. The operator may pull the relay unit 152 or 158 toward the operator, gripping a handle 164. When the relay unit 152 or 158 is pushed to a preselected mounting position. rollers 166 built in the apparatus body 300A or 301A and rollers 168 built in the usual discharge section 118 face each other. In this condition, the sheet S is driven out onto the transport over 138. The covers 138 and 144 are constructed in the same manner as in the previous embodiments.

Figure 16:
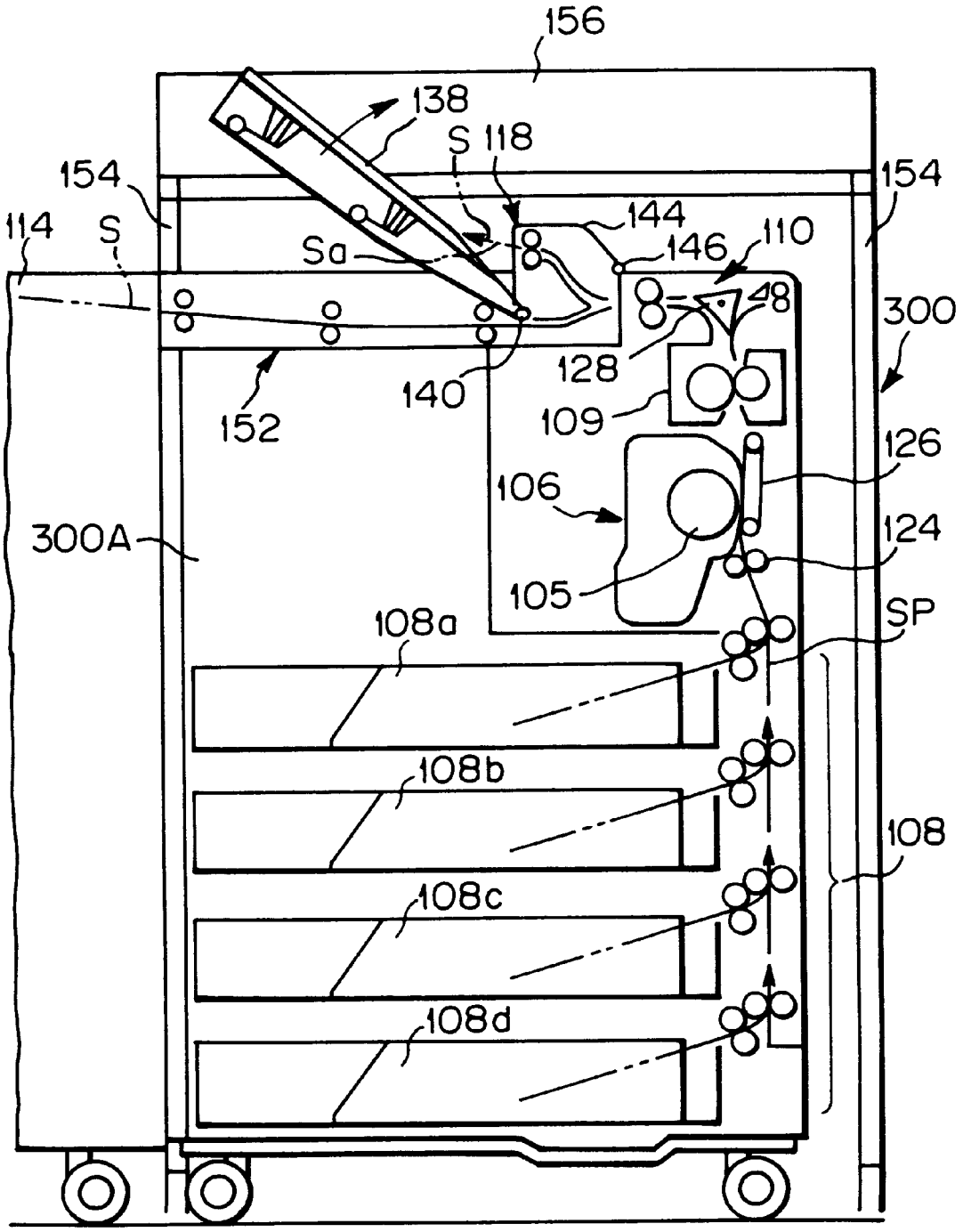
FIG. 16 shows the relay unit of the fifth embodiment pulled out, and a transport cover opened.
Figure 17:
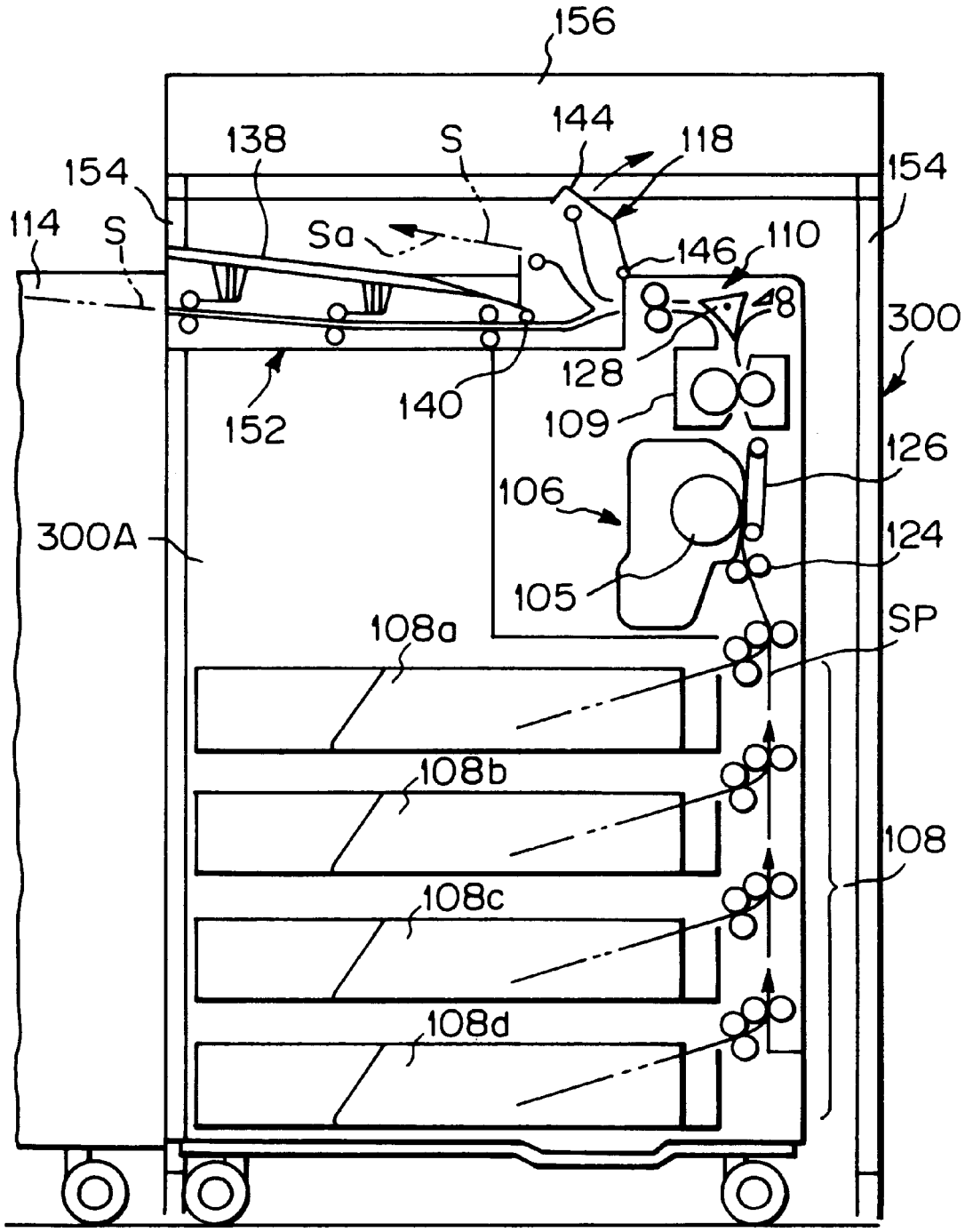
FIG. 17 is a side elevation showing the relay unit of the fifth embodiment pulled out, and a discharge cover opened.
Figure 18:
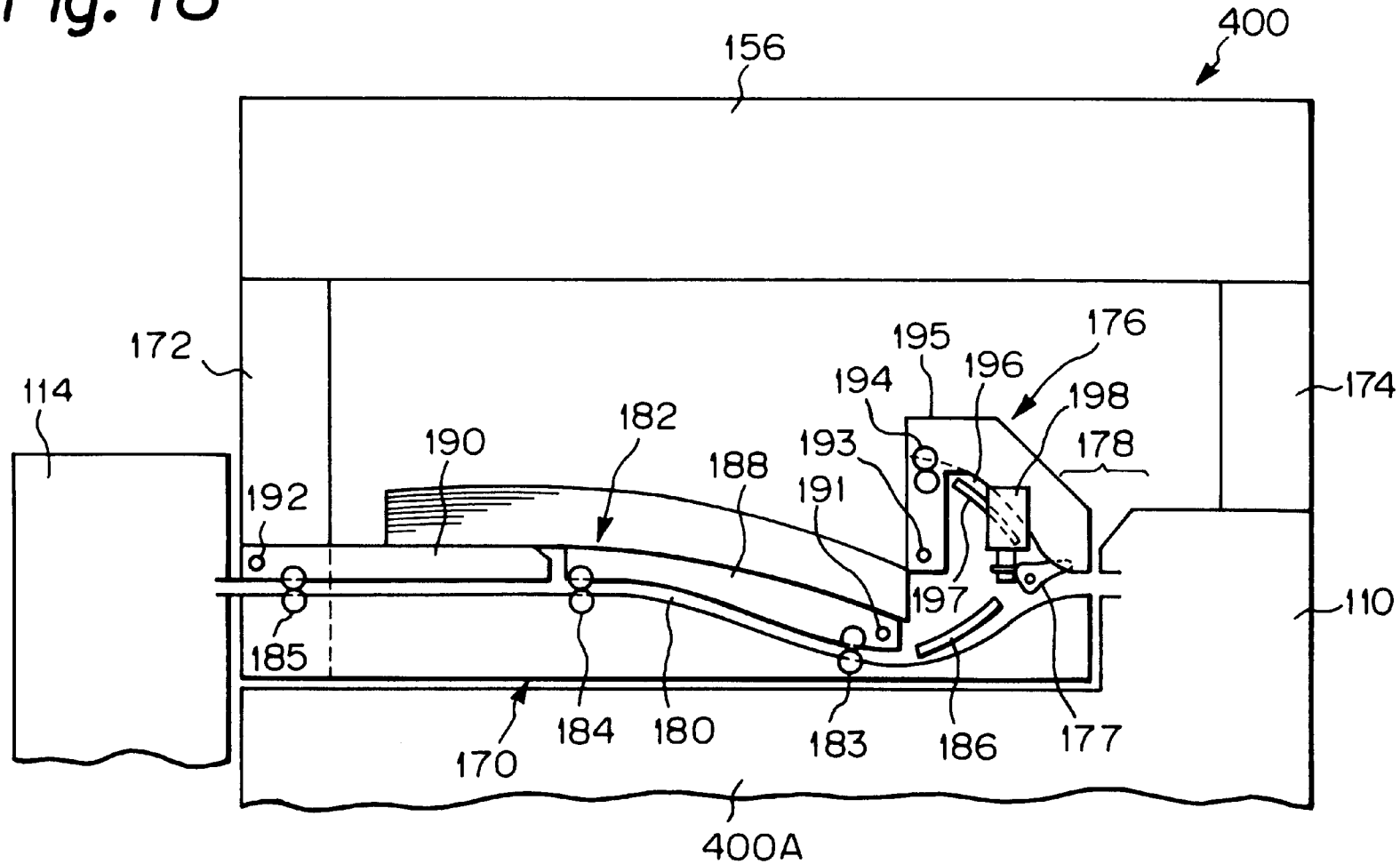
FIG. 18 is a side elevation showing a sixth embodiment of the present invention.

As shown in FIG. 16, when the operator pulls the relay unit 152 toward the operator and then opens the transport cover 138 in the direction indicated by an arrow, the scanner 156 and cover 138 are prevented from interfering with each other. This guarantees a sufficient working space at the time of removal of a jamming sheet. As shown in FIG. 17, to remove a sheet jamming the usual sheet discharge section 118, the relay unit 152 is also pulled toward the operator, and then the discharge cover 144 is opened. This reduces the space between the scanner 156 and the relay unit 152 as far as possible, and obviates awkward operation ascribable to the excessive height of the apparatus. Moreover, the cover transport 138 plays the role of a tray for the usual sheet discharge section 118 at the same time, simplifying the arrangement of the upper portion of the apparatus.

6th Embodiment

FIGS. 18–21 show a sixth embodiment of the present invention. In this embodiment, the same or similar structural elements as or to the elements of the previous embodiments are designated by the same reference numerals, and a detailed description thereof will not be made in order to avoid redundancy. As shown, an image forming apparatus 400 includes a body 400A accommodating a relay unit 170 at the center thereof. A scanner or image reading device 156 is mounted on the apparatus body 400A above the relay unit 170 via spacers 172 and 174.

The relay unit 170 has a usual sheet discharge section 176 integrally therewith. The sheet is transferred from the discharge section 110 of the apparatus body 400A to a usual discharge section 176 by way of a transfer section 178. A path selector or path selecting means 177 disposed in the sheet discharge section 176 steers the sheet toward the finisher 114 or causes it to be driven out via the sheet discharge section 176. The portion of the relay unit 170 adjoining the finisher 114 has a transport cover 182 for stacking sheets driven out of the usual discharge section 176, a transport path 180 for guiding the sheet from the path selector 177 to the downstream side and including a guide 186, and conveyor roller pairs 183, 184 and 185.

The transport cover 182 is divided into two cover parts 188 and 190 in the direction of sheet transport. The cover part 188 adjacent to the usual discharge section 176 has its rear end in the direction of sheet transport supported by a shaft 191, and is rotatable up and down about the shaft 191. The other cover part 190 adjacent to the finisher 114 has its front end in the above direction supported by a shaft 192, and is also rotatable up and down about the shaft 197. The upper surface of the transport cover 182 is used to stack sheets in the usual sheet discharge mode.

The usual discharge section 176 has a discharge roller pair 194, a discharge cover 195 carrying the upper roller of the roller pair 194 therewith, a guide 197 forming a sheet discharge path 196 between it and the discharge cover 195, and a solenoid or drive means 198 for driving the path selector 177. The cover 195 is supported by a shaft 193 at its side remote from the transfer section 178 and rotatable up and down. The solenoid 198 is affixed to the cover discharge 195.

Figure 19:
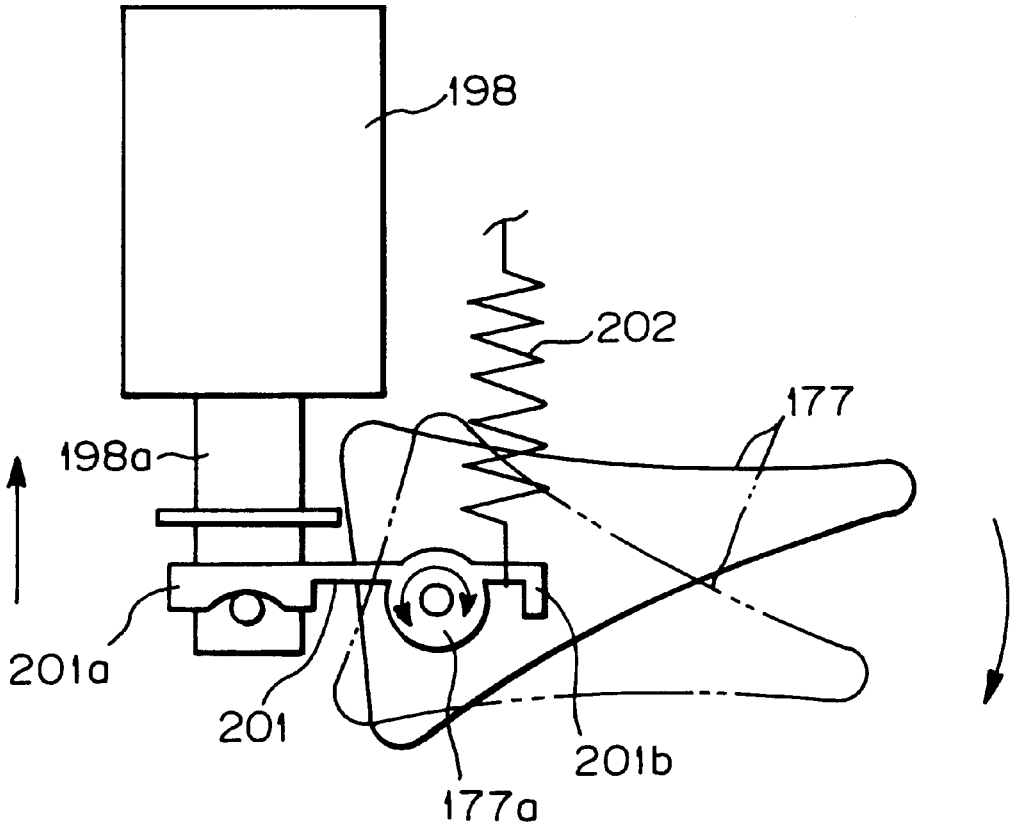
FIG. 19 shows the configuration of a path selecting device included in the sixth embodiment.

As shown in FIG. 19, the path selector 177 has a shaft 177*a* with which an arm 201 is formed integrally. One end 201*a* of the arm 201 is engaged with a plunger 198*a* extending from the solenoid 198. A spring 202 is anchored to the other end 201*b* of the arm 201. In this condition, the path selector 177 is constantly biased toward a position where it steers sheets toward the finisher 114, as indicated by a solid line. In the usual sheet discharge mode, the solenoid 198 is turned on to switch the path selector 177 to a position indicated by a dash-and-dots line.

Figure 20:
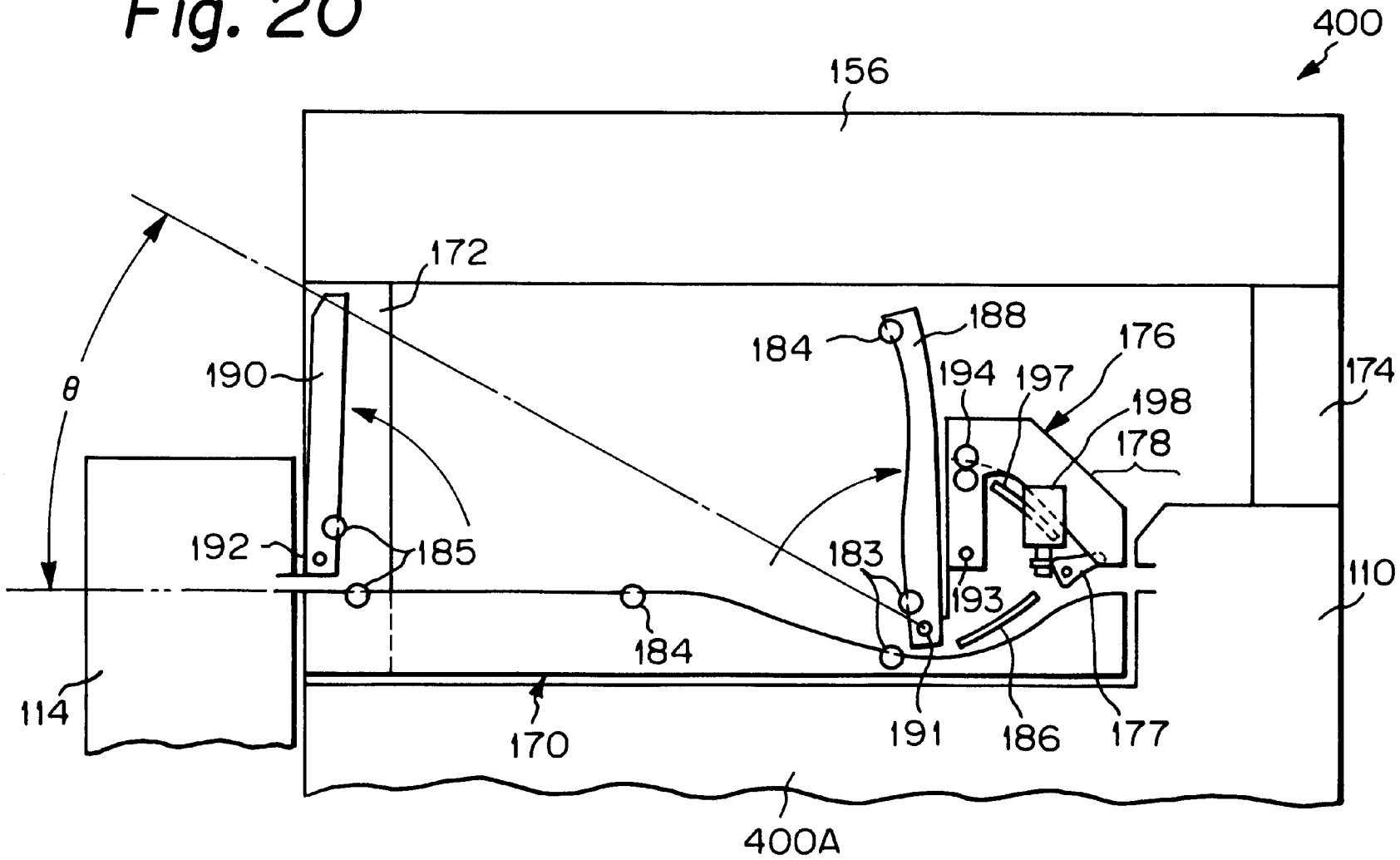
FIG. 20 is a side elevation of a transport cover included in the sixth embodiment and rotated to uncover a sheet transport path.

Assume that a sheet has jammed the path 180. Then, as shown in FIG. 20, the operator raises one or both of the cover parts 188 and 190 in order to uncover the path 180. If the transport cover 182 is implemented as a single member, then the maximum angle to which the cover 182 can be opened is only θ. The resulting space is too narrow for the operator to access the path 180, and in addition different in opening degree in the right-and-left direction. In the illustrative embodiment, the path 180 can be substantially fully opened without interfering with the scanner 156, facilitating the removal of a jamming sheet. Because the cover parts 188 and 190 separated from each other reduce the length, the spacers 172 and 174 can be reduced in height. This prevents the operation surface of the scanner 156 from increasing in level.

Furthermore, only one of the cover parts 188 and 190 can be opened in order to uncover only a part of the path 180 jammed by a sheet. In this case, because the space above the cover part not opened is available for jam processing, the jam processing can be performed in the same manner as when both the covers 188 and 190 are opened.

While the covers 188 and 190 are openable independently of each other in the above embodiment, one of them may be opened in interlocked relation to the other. The interlocked configuration will facilitate the operation for fully uncovering the path 180.

The opening/closing structure of the cover 195 included in the usual sheet discharge section 176 stems from the fact that sheet jams are likely to occur at tie transfer section 178.

Figure 21:
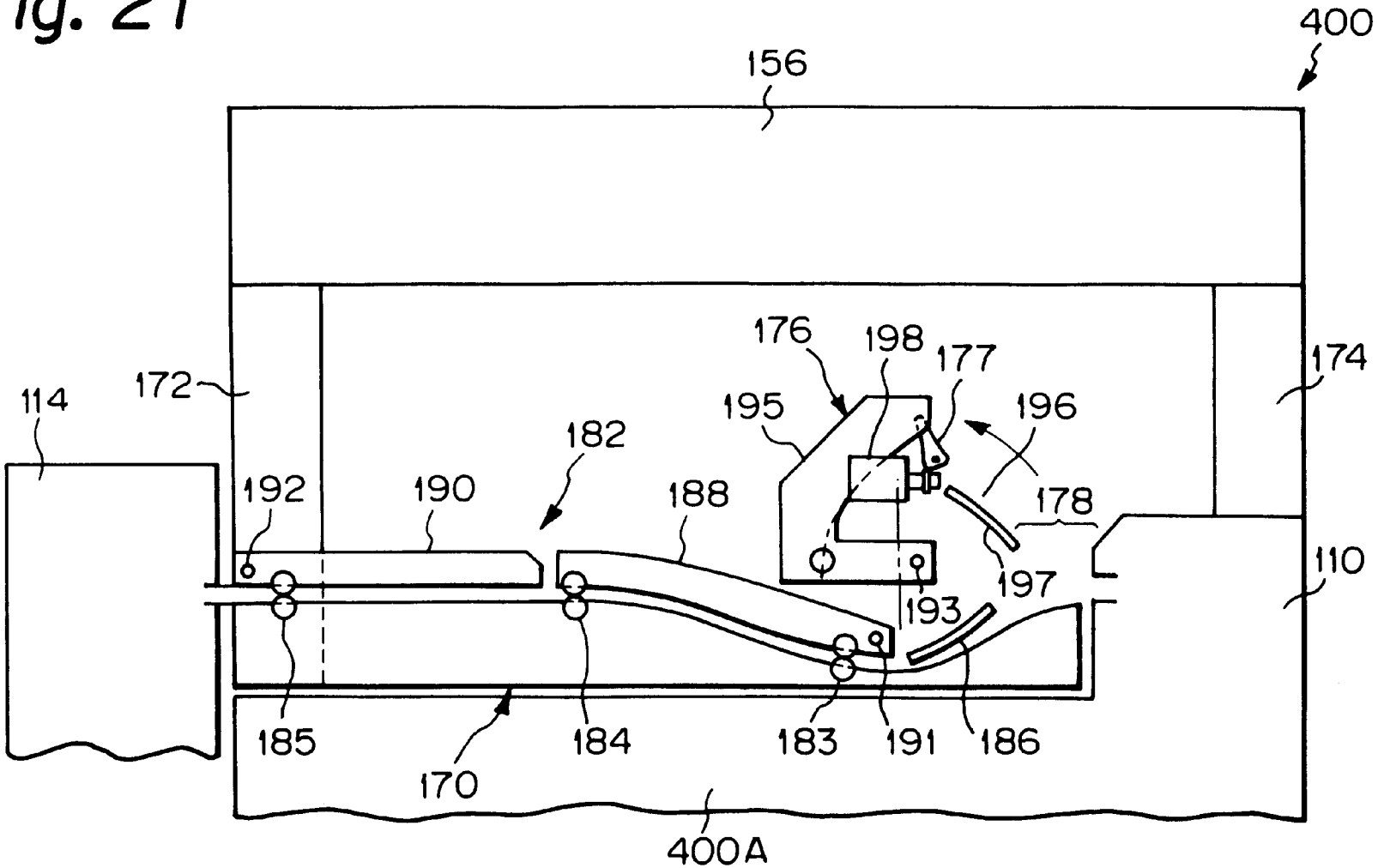
FIG. 21 is a side elevation showing a discharge cover of the sixth embodiment in its open position.

As shown in FIG. 21, when a am occurs during usual sheet discharge, the discharge cover 195 is rotated upward so as to substantially fully uncover the path 196 and transfer section 178. Should the fulcrum about which the cover 195 is rotatable be located at the transfer section 178 side, it would be difficult to remove a sheet jamming the transfer section 178. In this embodiment, the transfer section 178 can be fully uncovered, facilitating jam processing.

The path selector 177 is mounted on the cover 195 via the solenoid 198. Therefore, the path selector 177 adjacent to the transfer section 178 moves in interlocked relation to the discharge cover 195, further increasing the space available for the removal of a jamming sheet.

Because the solenoid 198 for driving the path selector 177 is supported by the cover 195, an extra frame for a mechanism for switching the path selector 177 is not necessary. This successfully reduces the number of parts, and therefore the cost.

7th Embodiment

Figure 22:
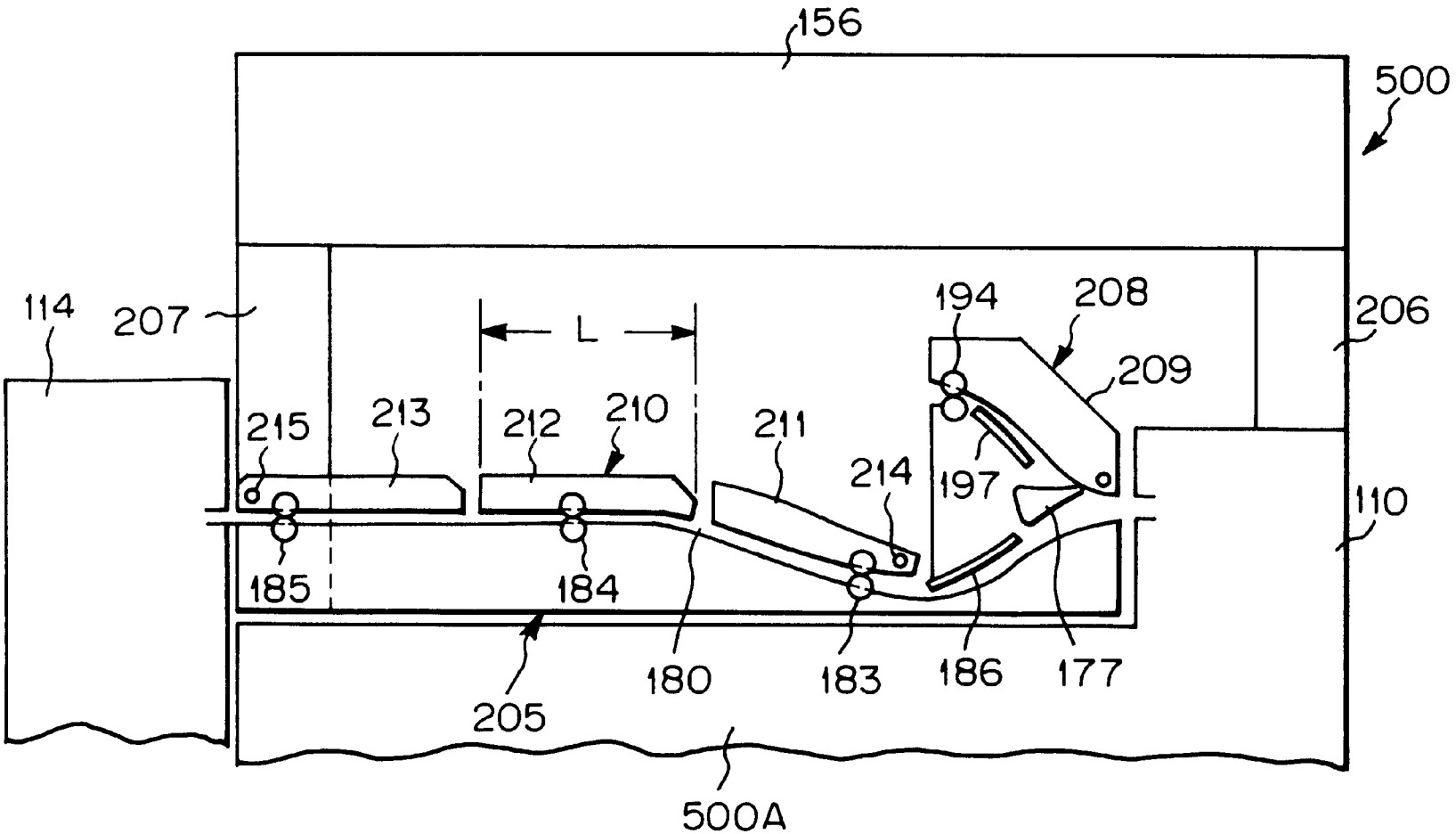
FIG. 22 is a side elevation showing a seventh embodiment of the present invention.
Figure 23:
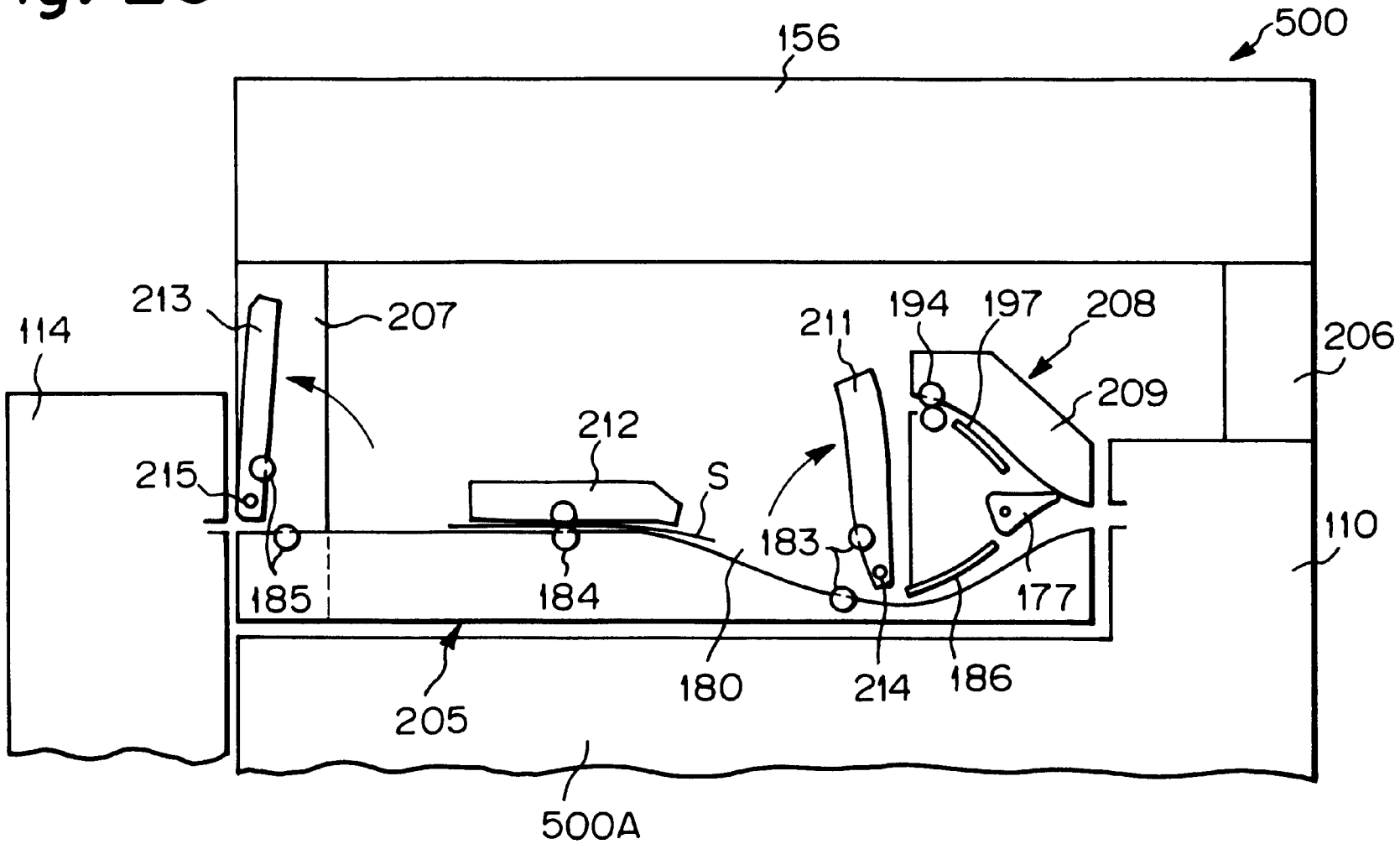
FIG. 23 is a side elevation showing a transport cover part included in the seventh embodiment and rotated to uncover a sheet transport path.
Figure 24:
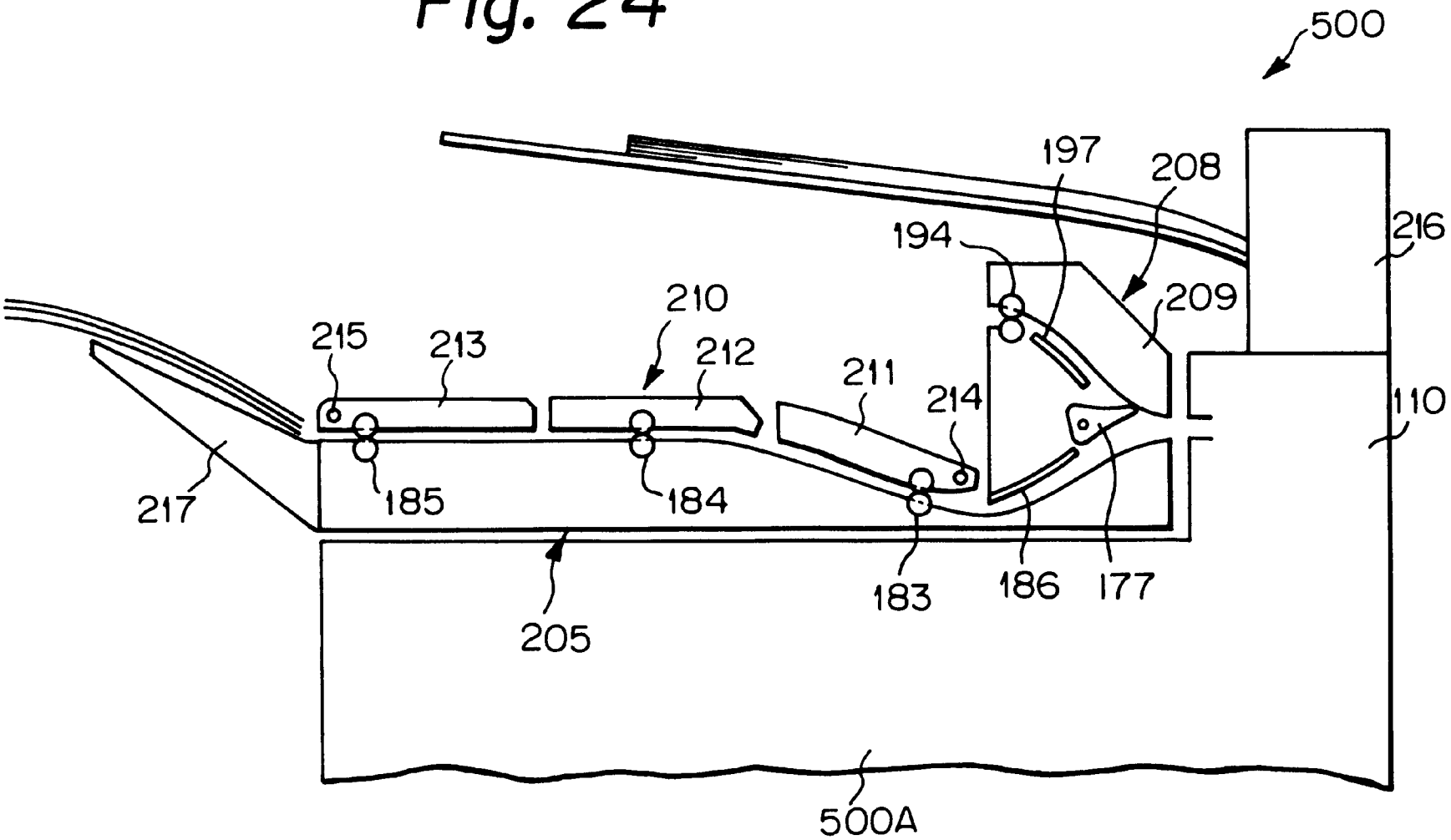
FIG. 24 is a side elevation showing a modification of the seventh embodiment.

FIGS. 22–24 show a seventh embodiment of the present invention. In this embodiment, the same or similar structural elements as or to the elements of the previous embodiments are designated by the same reference numerals. As shown in FIG. 22, an image forming apparatus 500 includes a body 500A. A relay unit 205 is mounted on the top of the apparatus body 500A. The scanner 156 is mounted on the apparatus body 500A above the relay unit 205 via the spacers 172 and 174. The relay unit 205 includes a usual sheet discharge section 206 having a discharge cover 207. The discharge cover 207 is rotatable about a fulcrum located at the transfer section 178 side, as in the above embodiment.

A transport cover 210 included in the relay unit 205 consists of three cover parts 211, 212 and 213 separate in the direction of sheet feed. The cover part 211 adjacent to the usual sheet discharge section 206 is supported by a shaft 214 at its rear end in the direction of sheet transport. Further, the cover part 213 adjoining the finisher 114 is supported by a shaft 215 at its front end in the direction of sheet transport. The cover parts 211 and 213 are therefore rotatable up and down. The intermediate cover part 212 is fixed in place and has a length L smaller than the minimum sheet size as measured in the direction of sheet feed in the relay unit 205.

As shown in FIG. 23, when the sheet S jams the path 180, one or both of the cover parts 211 and 213 are rotated upward in order to partly uncover the path 180. Even if the sheet S stops below the intermediate fixed cover part 212, it can be easily removed because its leading edge or trailing edge protrudes from the cover part 212.

The length of the cover parts 211 and 213 is further reduced, compared to the two cover part configuration. This allows the level of the spacers 172 and 174 to be further lowered and prevents the operation of the scanner 156 from rising in level. Stated another way, the compact configuration of the cover guarantees a broad space for jam processing even when the space available between the apparatus body 500A and the scanner 156 is narrow.

As shown in FIG. 24, the scanner 156 and finisher 114 may be respectively replaced with a bin or sheet receiving means 216 having one or more bins and a tray 217. Such an alternative configuration, like the above configuration, facilitates easy removal of a jamming sheet.

8th Embodiment

Figure 25:
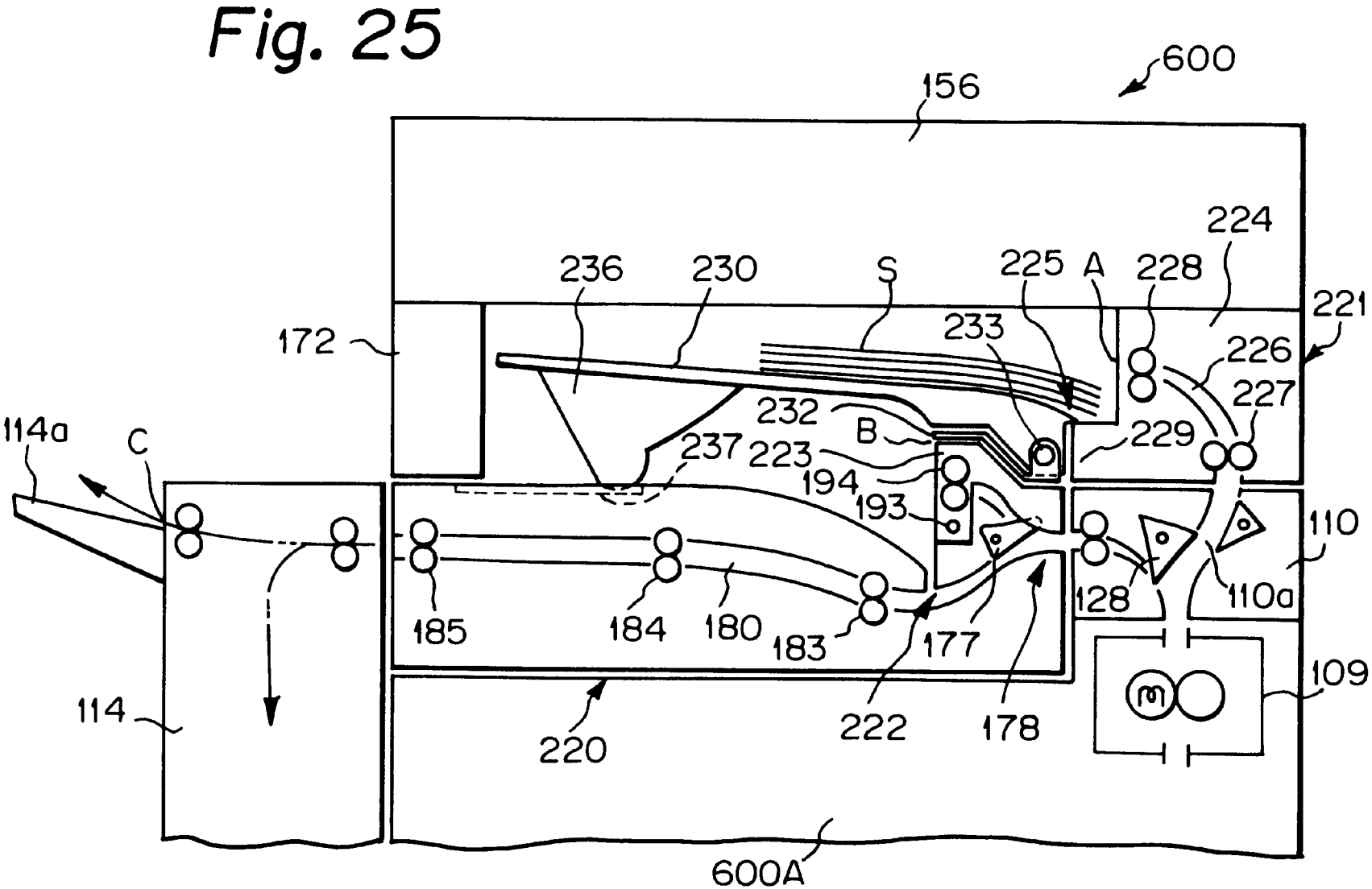
FIG. 25 is a side elevation showing an eighth embodiment of the present invention.
Figure 26:
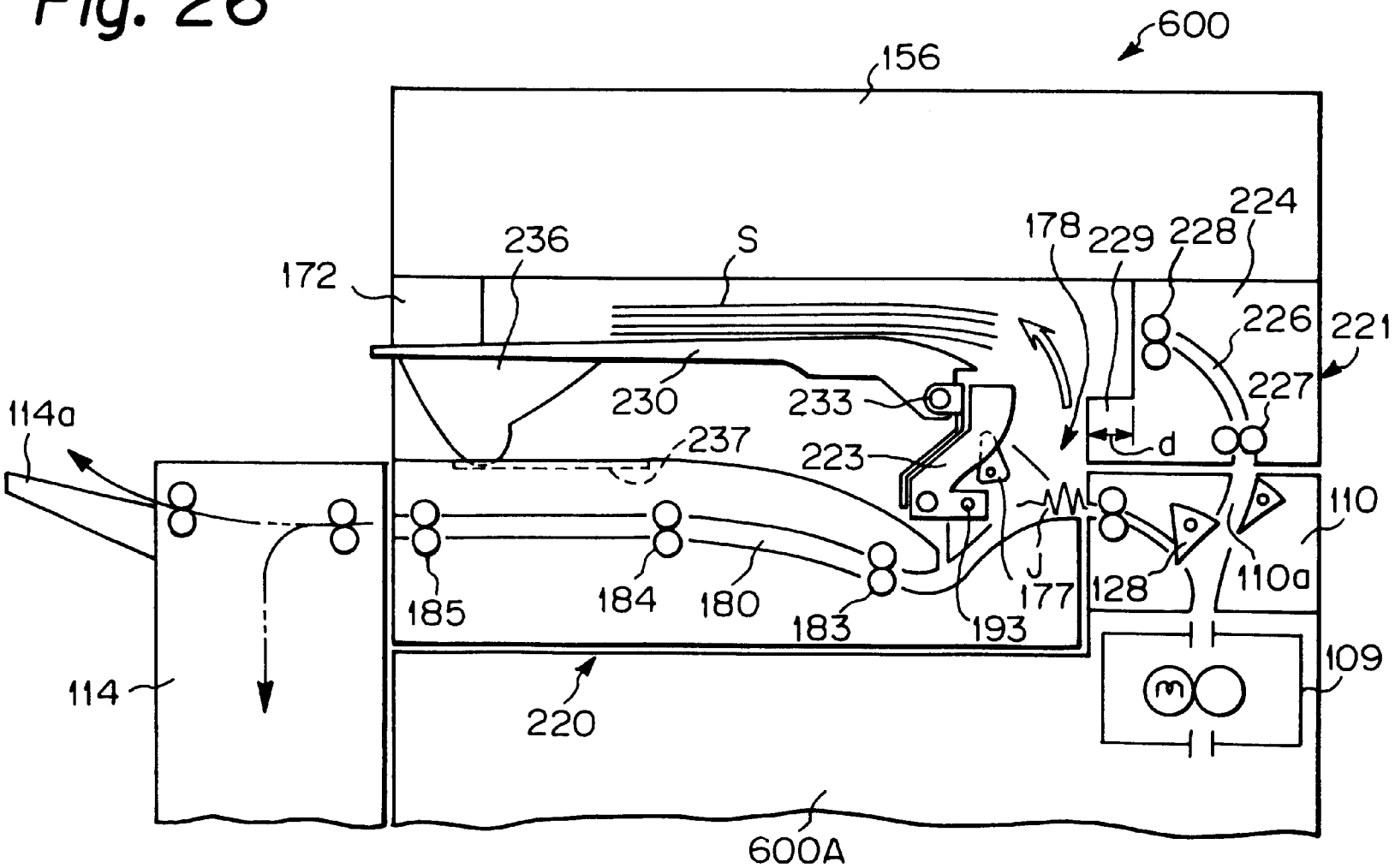
FIG. 26 is a side elevation showing a discharge cover included in the eighth embodiment and held in its open position.
Figure 27:
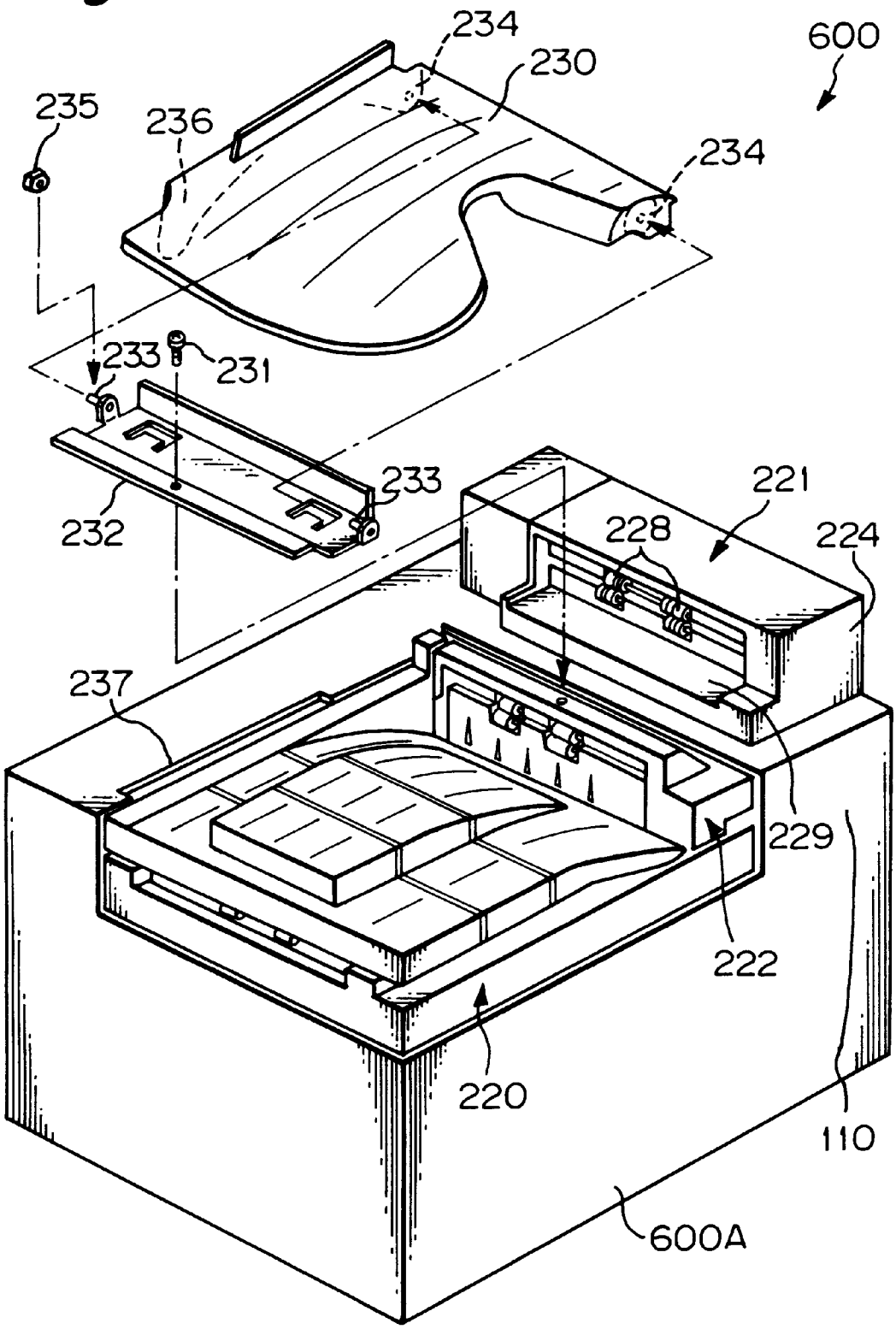
FIG. 27 is an exploded perspective view of the eighth embodiment.

Referring to FIGS. 25–27, an eighth embodiment of the present invention will be described. In this embodiment, the same or similar structural elements as or to the elements of the previous embodiments are designated by the same reference numerals. As shown in FIG. 25, an image forming apparatus 500 includes a body 600A on which a relay unit 220 is mounted. The scanner 156 is mounted on the apparatus body 600A above the relay unit 220 via a spacer 172 and a one-bin device 221. The one-bin device, or sheet receiving means. 221 is positioned above the sheet feed section 110 and has one or more bins. A usual sheet discharge section 222 is constructed integrally with a part of the relay unit 220 positioned above the sheet discharge section 110. The usual sheet discharge section 222 includes a discharge cover 223 rotatable up and down. Specifically, the discharge cover 223 has its end remote from the transfer section rotatably supported by a shaft 193, as in the sixth embodiment shown in FIG. 18.

The one-bin device 221 has a body 224 and a bin or tray 225. A sheet transport path 226 is formed in the body 224 and communicated to the path 110*a* extending upward from the sheet feed section 110. A conveyor roller pair 227 and a discharge roller pair 228 are mounted on the body 224. In the illustrative embodiment, the tray 225 of the one-bin device 221 directly serves as the lowermost tray. However, when a mail box having a plurality of trays is mounted on the apparatus body 600A, its lowermost tray will be affixed to the discharge cover 223.

The tray 225 is divided into a stationary portion 229 formed integrally with the lower portion of the body 224, and a movable portion 230 mounted on the discharge cover 223. Specifically, as shown in FIG. 27, a tray bracket 232 is fastened to the top of the cover 223 by screws 231. The movable portion 230 is mounted to the cover 223 via the tray bracket 232.

Stub shafts 233 protrude from the opposite ends of the tray bracket 232 while holes 234 are formed in the rear end of the movable portion 230 with respect to the direction of discharge. After the holes 234 have been engaged with the stub shafts 233, the bracket 231 is stopped by a stop ring 235. In this condition, the movable portion 230 is rotatable up and down relative to the discharge cover 223 while being prevented from slipping out. A leg 236 extends downward from the bottom of one side of the movable portion 230. The leg 236 slides on a channel or rail 237 formed on the top of the apparatus. When the movable portion 230 moves substantially horizontally, the leg 236 serves to maintain the position of the portion 230.

As shown in FIG. 25, when the discharge cover 223 is not open, the stationary portion 229 and movable portion 230 of the tray 225 are contiguous with each other. In this condition, the sheet S has its rear end portion positioned by the stationary portion 229 and has its other portion laid on the movable portion 230.

Assume that a sheet J jams the transfer section 178 between the relay unit 220 and the sheet discharge section 110. Then, as shown in FIG. 26, the operator raises the discharge cover 223 in the direction indicated by an arrow, uncovering the transfer section 178. At this instant, the movable portion 230 of the tray 225 moves substantially horizontally while slightly moving up and down, in interlocked relation to the cover 223. Because the position of the movable portion 230 is maintained by the leg 236, the sheets S stacked on the movable portion 230 are prevented from being dislocated. In addition, when the cover 223 is closed, it is prevented from contacting and damaging the rear end of the sheet stack.

The stationary portion 229 of the tray 225 has a length d, as measured in the direction of sheet discharge, selected such that the portion 229 does not protrude horizontally into the space above the transfer portion 178 when the discharge cover 223 is opened. This prevents the portion 229 from obstructing jam processing.

If the tray 225 is implemented as a single member, then the portion corresponding to the stationary portion 229 will remain above the transfer section 178 when the discharge cover 223 is opened, obstructing jam processing. This embodiment with the above configuration eliminates this problem and allows the jamming sheet J to be removed with ease.

The ratio between the stationary portion 229 and the movable portion 230 with respect to the length in the direction of sheet discharge is selected such that when the discharge cover 223 is opened, the sheet remains on the portion 230 due to friction derived from its own weight. Therefore, the sheet remains on the movable portion 230 without fail during movement of the portion 230.

As shown in FIG. 25, the apparatus 600 has three different sheet outlets, i.e., an output A for discharging the sheet to the tray 125, an outlet B for discharging it the top of the relay unit 220, and an outlet C for discharging it to the tray 114*a* of the finisher 114. Therefore, when the apparatus 600 is implemented as a multifunction machine having the functions of a copier, facsimile apparatus and printer, the three outlets A–C can be selectively used. This surely prevents sheets output by one function from being mixed with sheets output by another function.

The tray or lowermost tray 225 of the one-bin device 221 located above the sheet discharge section 110 is movable together with the discharge cover 223, as stated earlier. This obviates the above mixture of sheets output by different functions while insuring easy jam processing.

The third to eighth embodiments shown and described have the following various advantages.

(1) A mail box or similar sheet receiving device positioned above and in close proximity to a relay unit has a rotatable tray. Therefore, when a cover is opened in order to remove a sheet jamming the relay unit, the tray retracts in accordance with the opening of the cover and provides a sufficient space for the removal of the sheet. It is possible to make the most of the merits of the coexistence of finishers implemented by the relay unit.

(2) The tray rotates in interlocked relation to the opening of the cover. This further broadens the space available for jam processing and thereby facilitates the operator's manipulation, while making it needless for the operator to raise the tray.

(3) The relay unit can be pulled cut toward the operator. This prevents the relay unit from interfering with a scanner or a mail box mounted on the apparatus, and guarantees a sufficient space for jam processing. Further, the distance between the scanner, mail box or the like and the relay unit can be reduced as far as possible, preventing the height of the apparatus from increasing.

(4) A transport cover included in the relay unit consists of a plurality of cover parts separate in the direction of sheet transport. At least one of the cover parts is supported by a shaft at one end thereof so as to be rotatable up and down. The transport cover can therefore be widely opened and facilitates the removal of a jamming sheet. Because the individual cover part is compact, it rotates with only a small radius and prevents the operation surface of a scanner from increasing in level.

(5) The cover consists of three parts separated from each other, and only the intermediate cover part is fixed in place. This makes the configuration of the cover parts further compact and obviates the increase in the level of the operation surface of the scanner more positively. As a result, the entire apparatus is provided with a compact configuration.

(6) The intermediate or stationary cover part has a length smaller than the minimize sheet size as measured in the direction of sheet transport. Therefore, even when a sheet stops a path below the cover, its leading edge or trailing edge protrudes from the cover part and can be pulled out with ease.

(7) The relay unit includes a usual sheet discharge section having a discharge cover. The discharge cover is movable up and down about a fulcrum located at the opposite side to a transfer section intervening between the relay unit and the apparatus body. Therefore, the transfer section where a sheet jam is most likely to occur can be uncovered, further promoting easy removal of a jamming sheet.

(8) A path selector is supported by the discharge cover and therefore moves when the cover is opened. This further facilitates the removal of a jamming sheet.

(9) Drive means for driving the path selector is also supported by the discharge cover. This makes it needless to provide a frame or the like for a mechanism which actuates the path selector, thereby reducing the number of parts and the cost.

(10) A sheet receiving device having one or more bins is located above a sheet discharge section and has its lowermost tray constructed integrally with the discharge cover of the usual sheet discharge section. In this configuration, the lowermost tray is movable in interlocked relation to the opening of the discharge cover. This prevents the lowermost tray from obstructing the removal of a jamming sheet. As a result, the number of sheet outlets, i.e., the number of functions available with the apparatus can be increased without effecting the easy removal of a jamming sheet.

(11) The lowermost tray is movable substantially horizontally in unison with the rotation of the discharge cover. This prevents sheets stacked on the tray from being dislocated during the movement of the tray.

(12) The lowermost tray consists of a stationary portion and a movable portion. The stationary portion has a length selected such that it does not protrude horizontally to above a space available when the discharge cover is opened. Therefore, a jamming sheet can be removed as easily as when the lowermost tray is absent.

(13) The stationary portion and movable portion of the lowermost tray are provided with such a ratio that the sheet remains on the movable portion due to its own weight when the discharge cover is opened. The sheet is therefore prevented from being dislocated due to friction acting between it and the stationary portion during the movement of the movable portion.

9th Embodiment

Figure 28:
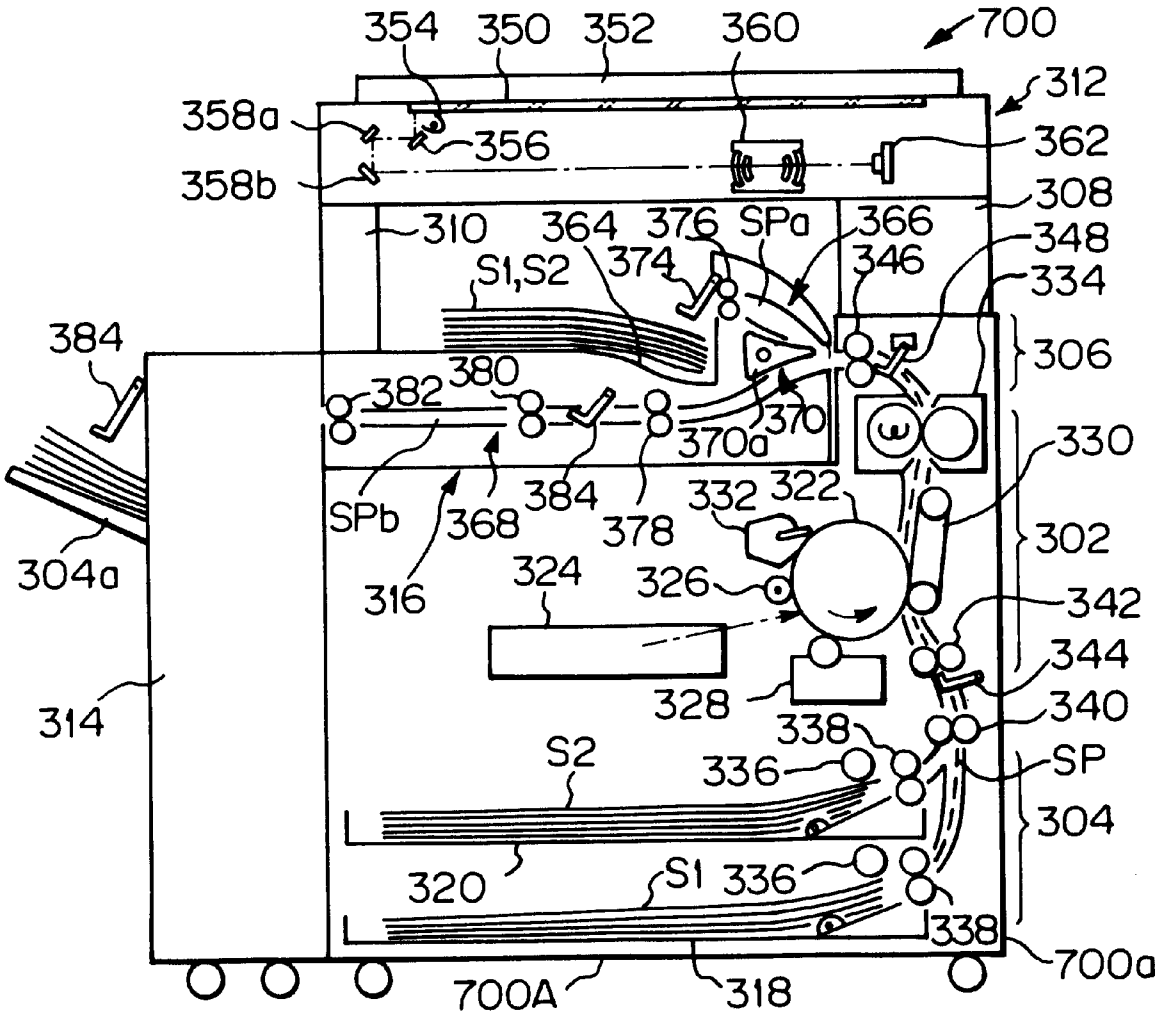
FIG. 28 is a side elevation showing a ninth embodiment of the present invention.

Referring to FIGS. 28–33, a ninth embodiment of the present invention will be described. As shown in FIG. 28, an image forming apparatus 700 includes a body 700A accommodating an image forming section 302. A sheet feed section 304 and a sheet discharge section 306 are located below and above the image forming section 302, respectively. A scanner 312 is mounted on the apparatus body 700A above the sheet discharge section 306 via spacers 308 and 310. A sorter, sorter/stapler or similar finisher 314 is mounted on one side of the apparatus body 700A and includes a stack portion 314*a*. A relay unit 316 is mounted on the top of the apparatus body 700A and has its own sheet transport path and conveying function arranged along the top of the apparatus body 700A. The sheet feed section 308 includes a plurality of cassettes 318 and 320 respectively loaded with sheets S1 and S2 of, e.g., different sizes. The transport path SP extends substantially vertically from the sheet feed section 304 to the sheet discharge section 306 via the image forming section 302.

The image forming section 302 includes an image carrier implemented as a drum 322 rotatable counterclockwise, as viewed in FIG. 28. An optical writing unit 324 electrostatically forms a latent image on the drum 322. Arranged around the drum 322 are a main charger 326 for uniformly charging the drum 322, an eraser, not shown, for erasing charge deposited on a non-image area, a developing unit 328 for transforming the latent image to a toner image, an image transfer device 330 for transferring the toner image from the drum 322 to a sheet while conveying the sheet, a cleaning unit 322 for removing toner remaining on the drum 322 after the image transfer, and a discharger, not shown, for dissipating the charge also remaining on the drum 322 after the image transfer. A fixing unit 334 is positioned between the image transfer device 330 and the sheet discharge section 306. The fixing unit 334 fixes the toner image transferred to the sheet by heat and pressure.

The optical writing unit 324 transforms image data output from the scanner 312 to an optical signal, and writes a latent image representative of a document image on the drum 322. The writing unit 324 may write a latent image in accordance with image data output from a personal computer. The writing unit 324 scans the surface of the drum 322 with a laser beam issuing from a laser. Specifically, the laser is steered by a conventional polygonal mirror and then routed through a mirror and fθ lens to the drum 322.

A sheet S1 or S2 is fed by a pick-up roller 336 while being separated by the underlying sheets by a separator roller pair 338. Then, the sheet S1 or S2 is conveyed by a conveyor roller pair 340 along the substantially vertical path SP. A registration roller pair 342 precedes the image transfer device 330 in the direction of sheet transport. The roller pair 342 drives the sheet S1 or S2 at a predetermined timing to a nip between the image transfer device 330 and the drum 322. A sheet sensor 344 precedes the registration roller pair 342 in the above direction.

The sheet discharge section 306 includes a discharge roller 346. A sheet discharge sensor 348 precedes the discharge roller pair 346 and is the most downstream sensor with respect to the vertical path SP.

The scanner 312 includes a glass platen 350 for laying a document thereon. A cover plate 352 presses the document against the glass platen 350 and has a white pressing surface. A lamp 354 illuminates the document laid on the glass platen 350. The resulting reflection from the document is reflected by a mirror 356. A pair of mirrors 358*a* and 358*b* are movable at one half of the speed of the mirror 356. A lens 360 and a CCD (Charge Coupled Device) image sensor 362 are also arranged in the scanner 312.

The major process units of the image forming section 302, the sheet feed section 304 and the sheet discharge section 306 are accommodated in the apparatus body 700A. The substantially vertical sheet path SP is almost fully exposed to the outside only if a side wall 700*a* forming part of the apparatus body 700A is opened. This promotes easy removal of a sheet jamming the path SP.

The relay unit 316 includes a stack section 364 for stacking sheets carrying images thereon and sequentially driven out via the sheet discharge section 306. A conveying device 366 conveys the sheet from the discharge section 306 to the stack section 364 while a conveying device 368 conveys the sheet toward the finisher 314. A path selector 370 steers the sheet coming out of the discharge section 306 toward the stack section 364 or the finisher 314. A controller 372 (see FIG. 29) controls the path selector 370. A full-stack sensor or full-stack sensing means 374 is associated with the stack section 364 in order to sense the full condition of the section 364.

The finisher 368 includes a sheet path SPb connecting the discharge section 306 and finisher 314, roller pairs 378 and 380, an outlet roller pair 382 located downstream of the roller pair 380 for discharging the sheet to the finisher 314, and a sheet sensor 384 intervening between the roller pairs 378 and 380. Another full-stack sensor 384 is associated with the stack portion 304*a* of the finisher 314. The path selector 370 consists of a switching member 370*a* and a solenoid 370*b* (see FIG. 29) for driving it.

Figure 29:
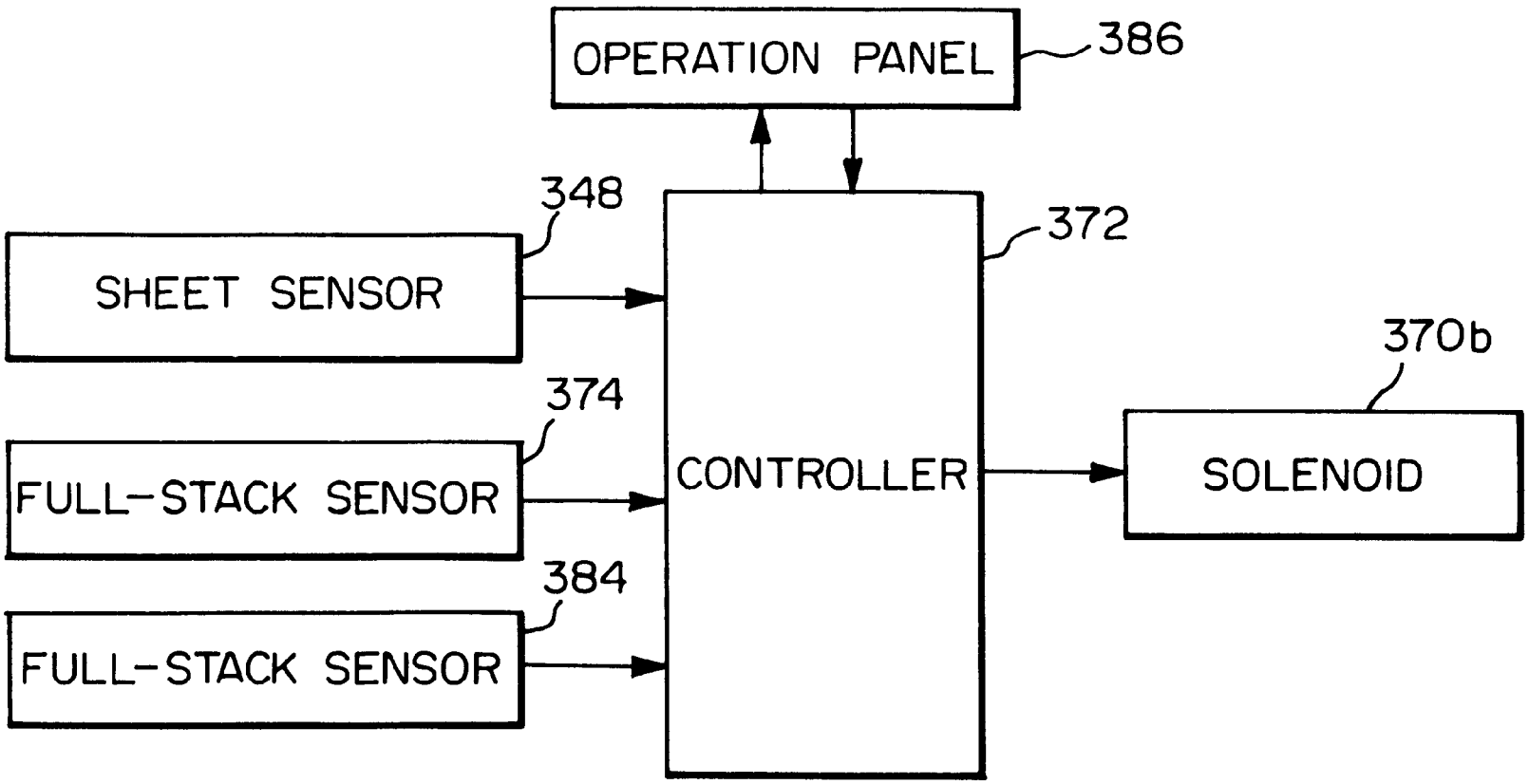
FIG. 29 is a block diagram schematically showing a control system included in the ninth embodiment.

The controller 372 is implemented as a microcomputer. As shown in FIG. 29, the outputs of various sensors including the sheet discharge sensor 348 and full-stack sensors 374 and 384 are input to the controller 372. In response, the controller 372 selectively turns on or turns off the solenoid 370*b*. An operation panel 386 is also connected to the controller 372 and allows processing using the finisher 314 to be input thereon.

In operation, the main charger 26 charges the surface of the drum 322 uniformly. The writing unit 324 scans the charged surface of the drum 322 with a laser beam in accordance with the image data output from the scanner 312 or from a personal computer, thereby forming a latent image on the drum 322. After the eraser has erased the charge of the non-image area of the drum 322, the developing unit 328 develops the latent image with charged toner so as to produce a corresponding toner image. The sheet S1, for example, is fed from the cassette 318 by the pick-up roller 336, separated from the others by the separator roller pair 338, and fed into the sheet path SP. The registration roller pair 342 drives the sheet S1 toward the image transfer device 330 such that the leading edge of the sheet meets that of the toner image of the drum 322 at the nip between the drum 322 and a belt included in the device 330. The sheet S1 carrying the toner image thereon is brought to the fixing unit 334 to have the toner image fixed thereby, as mentioned earlier.

Figure 30:
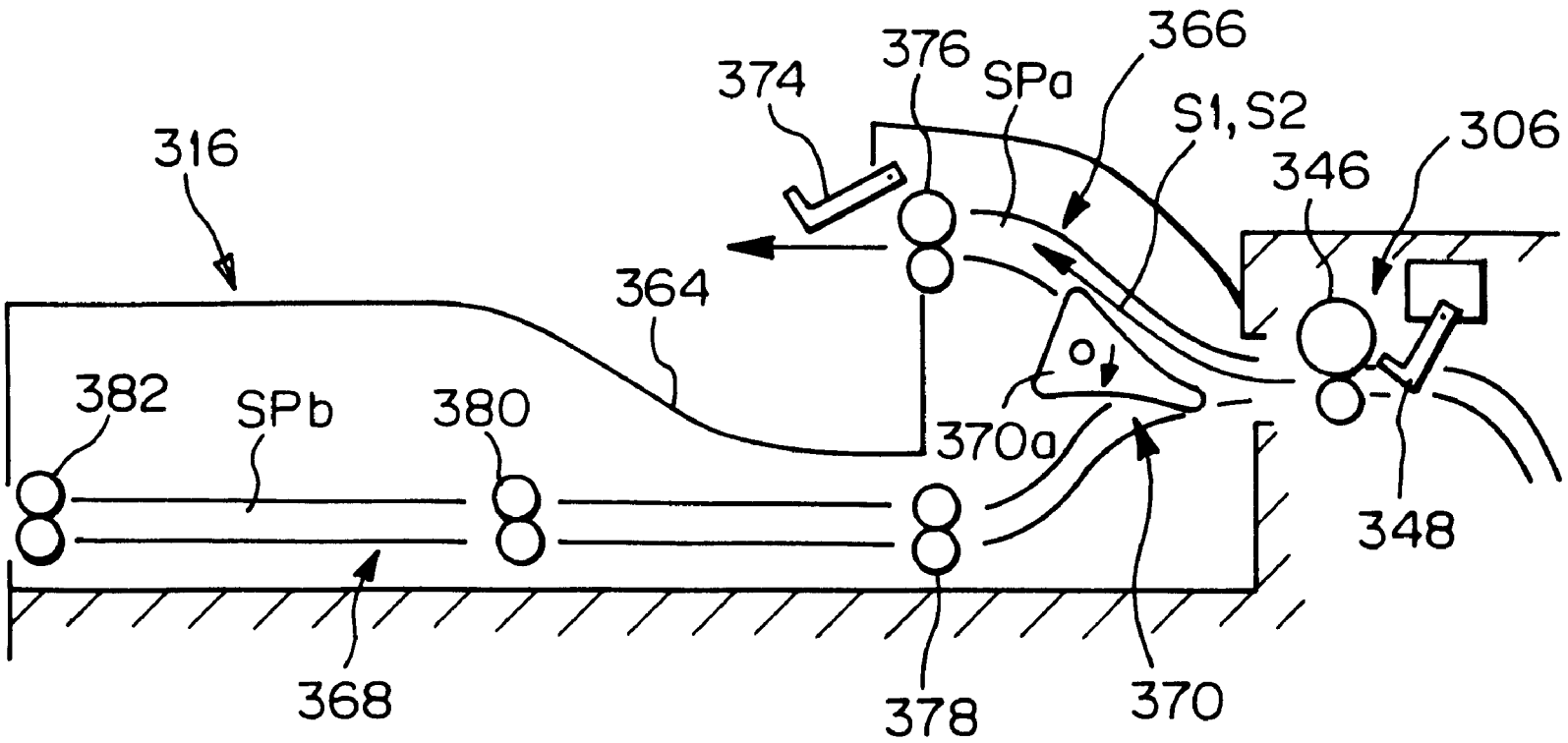
FIG. 30 is a side elevation demonstrating how the ninth embodiment conveys a sheet to a stick section included in a relay unit.

Assume that a mode not needing the finisher 314 is selected. Then, as shown in FIG. 30, the controller 372 turns on the solenoid 370*b* in order to move the switching member 370 to its lowered position. As a result, only the sheet path SPa of the conveying device 366 it unblocked. In this condition, the sheet S1 driven out via the discharge section 306 is conveyed by the conveying device 366 to the stack section 364. Let this sheet discharge be referred to as usual discharge.

Figure 31:
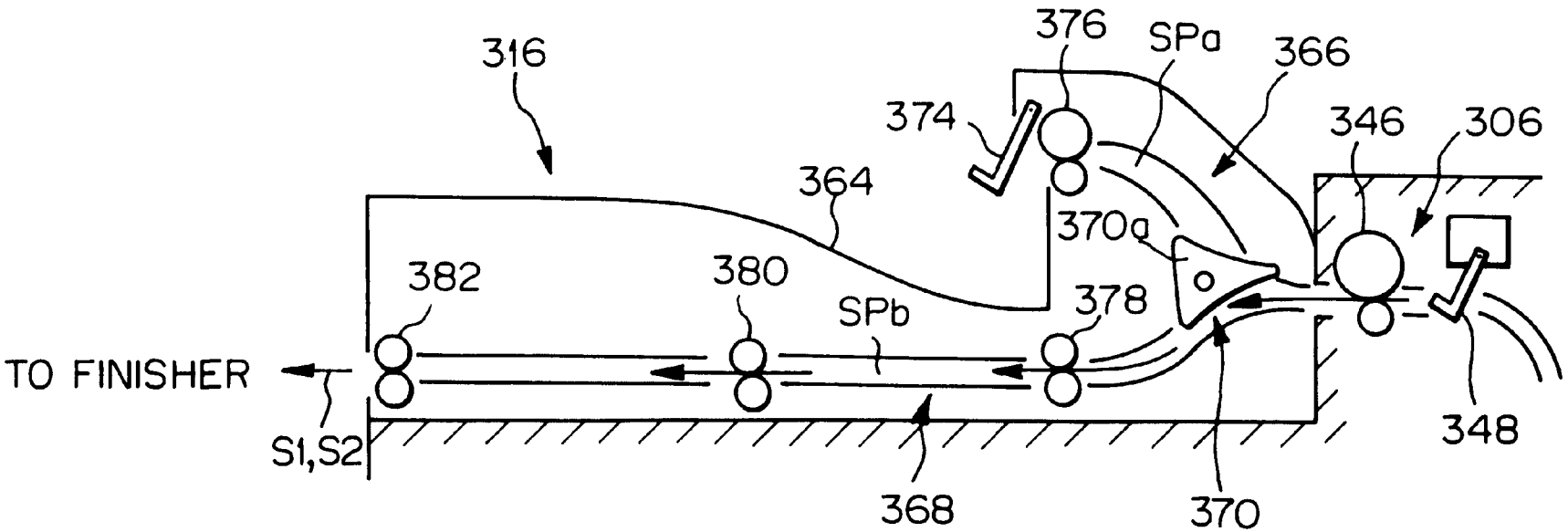
FIG. 31 is a side elevation demonstrating how the ninth embodiment conveys a sheet to a finisher.

On the other hand, assume that a mode needing the finisher 314, e.g., a staple mode is selected. Then, as shown in FIG. 31, the controller 372 does not turn on the solenoid 370 and thereby maintains only the sheet path SPb terminating at the finisher 368 open. As a result, the sheet S1 come out of the discharge section 306 is conveyed by the conveying device 368 to the finisher 314. The sheet S1 is subjected to stapling or similar job in the finisher 314, and then driven out to the stack section 304*a,* although not shown specifically.

Of course, the sheet S1 may be discharged to the stack section 304*a* of the finisher 314 by the usual discharge. However, in the illustrative embodiment, the sheet S1 is delivered to the stack section 364 in order to reduce the so-called first copy time, so long as finishing is not necessary.

Why the solenoid 370*b* is held in its OFF state for maintaining the conveying device 368 assigned to the finisher 314 unblocked is as follows. Generally, a greater number of sheets are stacked on the finisher than on the stack section 364, so that continuous sheet feed occurs over a long period of time. In light of this, the embodiment reduces the duty of the solenoid 370*b* so as to reduce the size and cost of the solenoid 370*b*.

The finisher 314 has a stapling function thereinside, although not shown.

Figure 32:
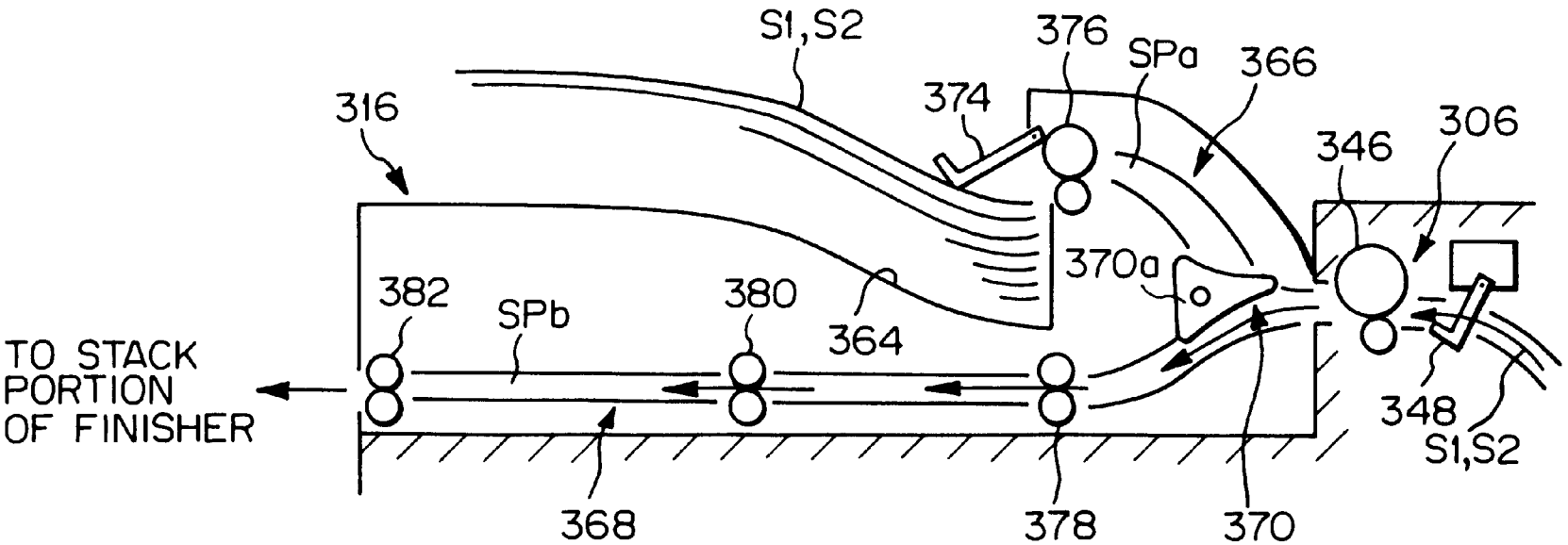
FIG. 32 is a side elevation showing how the ninth embodiment stacks sheet on the finisher when the stack section of the relay unit is filled up.

The relation between the stacking function and the full-stack sensor 374 will be described hereinafter. Assume that the mode not needing the finisher 314 is selected, and that a job exceeding the number of sheets which can be stacked on the stack section 364 of the relay unit 316 is executed. Then, as shown in FIG. 32, the controller 372 turns off the solenoid 370*b* in response to the output of tie full-stack sensor 374. As a result, the conveying device 368 assigned to the finisher 314 is selected. Therefore, images can be continuously formed on the number of sheets available with the relay unit 316 and the number of sheets available with the finisher 314. When the stack section 304*a* of the finisher 314 is full, as determined by the full-stack sensor 384, the above switching operation may not be effected.

Figure 33:
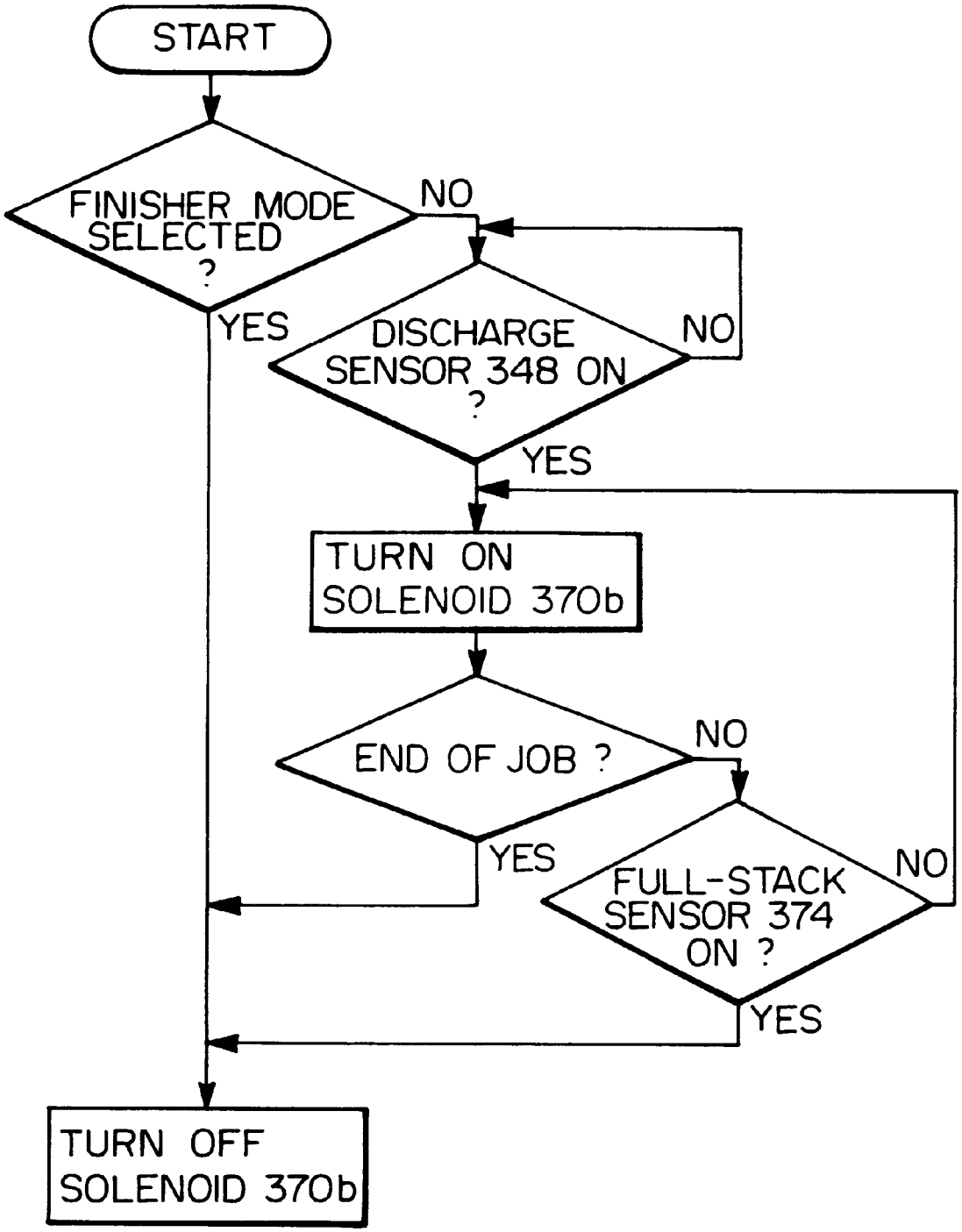
FIG. 33 is a flowchart demonstrating a specific operation of a controller included in the control system of FIG. 29.

FIG. 33 is a flowchart demonstrating the above operation of the controller 372. As shown, the controller 372 turns on the solenoid 370*b* in response to the output of the sheet discharge sensor 348 located at the downstream end of the sheet path SP.

The full-stack sensor 374 may include an arm to be rotated by the sheet being discharged, and sense the full condition on the basis of the position to which the arm returns. This kind of sensor is taught in, e.g., Japanese Patent Laid-Open Publication No. 4-280774.

As stated above, the finisher 314 is mounted on the apparatus body 700A in such a manner as not to increase the height or the weight of the body 700A. The relay unit 316 extending along the top of the apparatus body 700A communicates the sheet discharge section 306 to the finisher 314. This allows the finisher 314 to be used without lessening the advantages of the substantially vertical path SP.

As described above, the ninth embodiment has the following advantages.

(1) A relay unit extends along the top of an image forming apparatus and communicates a sheet discharge section of the apparatus to a finisher. In the relay unit, the usual sheet discharge and the transport to the finisher are selectively effected, depending on an operation mode selected. Therefore, the finisher can be used without lessening the advantages of a substantially vertical sheet transport path. When finishing is not necessary, sheets are delivered to a stack section included in the relay unit so as to reduce the first copy time.

(2) A sheet path terminating at the finisher is unblocked when path selecting means is turned off. This reduces the size and cost of a drive source for driving the path selecting means.

(3) When the output of full-stack sensing means shows that the number of sheets stacked in the relay unit has exceeded the capacity of the relay unit, the finisher is selected automatically. Therefore, images can be formed continuously on a number of sheets exceeding the capacity of the relay unit.

10th Embodiment

Figure 34:
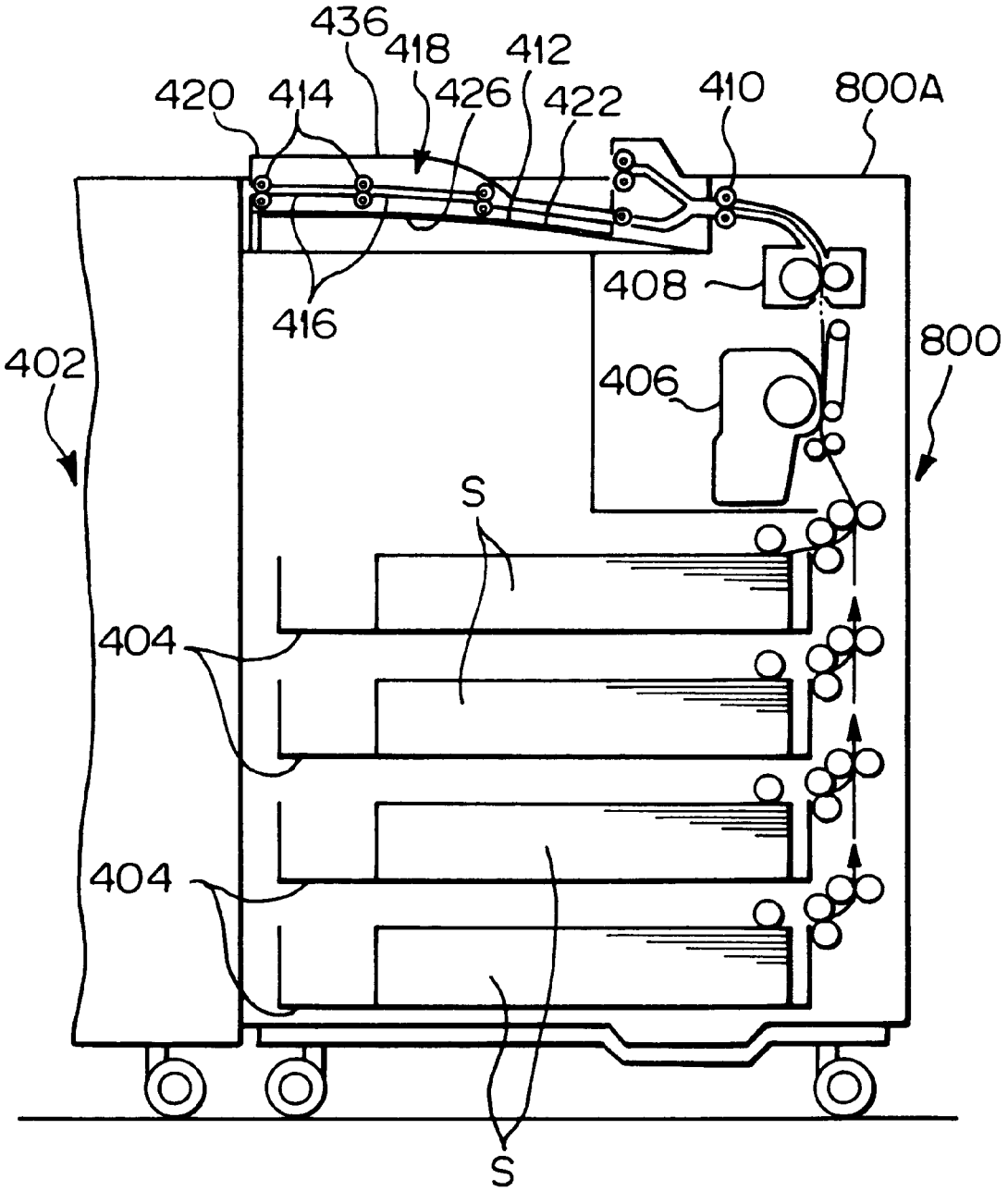
FIG. 34 is a side elevation showing a tenth embodiment of the present invention.

FIGS. 34–37 show a tenth embodiment of the present invention. As shown in FIG. 34, an image forming apparatus 800 has a sorter, sorter/stapler or similar finisher 402 mounted on one side thereof. The apparatus 800 includes a body 800A accommodating a plurality of trays 404 loaded with a stack of sheets each, an image forming section 406 for forming a toner image and transferring it to the sheet S fed from any one of the trays 404, and a fixing unit 408 for fixing the toner image on the sheet S, and so forth. A sheet discharge section 410 for discharging the sheet S and a stack section 412 for stacking the sheet S are located in the upper portion of the apparatus body 800A. When the finisher 402 is not used, the sheet S driven out via the discharge section 410 is delivered to the stack section 412.

A relay unit is interposed between the apparatus 800 and the finisher 402 in order to transfer the sheet S driven out via the discharge section 410 to the finisher 402. The relay unit includes a conveying mechanism 418 and a casing 420 accommodating the mechanism 418. The conveying mechanism 418 has a plurality of feed roller pairs 414, a guide 416, and so forth. The top of the stack section 412 is implemented as a convex inclined surface 422 inclined obliquely downward toward the discharge section 410. The inclined surface 422 is provided with a plurality of ribs 424, FIG. 35, extending in the direction of sheet discharge.

Figure 36:
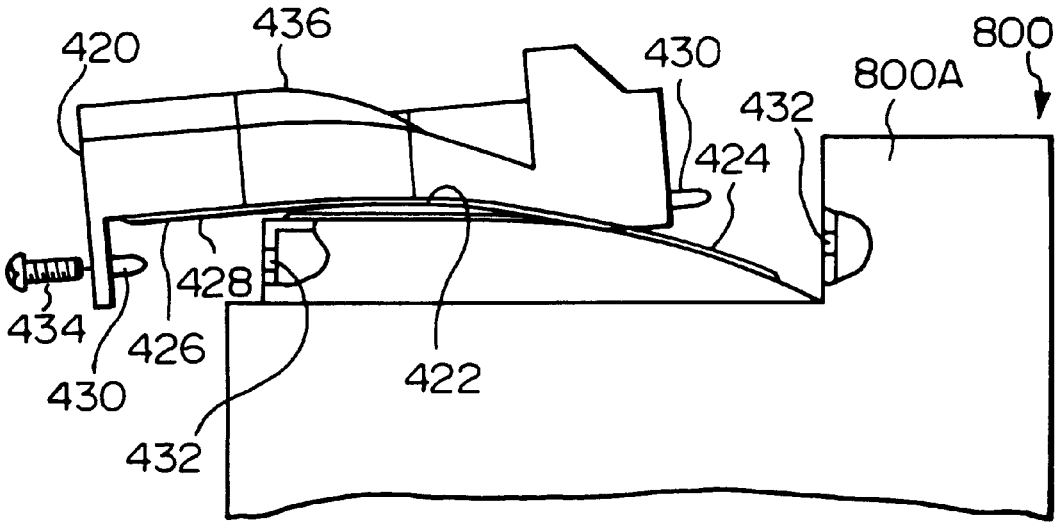
FIG. 36 is a view showing the casing of the tenth embodiment being mounted to the apparatus body.

The bottom of the casing 420 is implemented as a guide surface 426. When the casing 420 is put on the stack section 412 and then move toward a preselected mounting position, the guide surface 426 slides on the inclined surface 422. As shown in FIG. 36, a plurality of ribs 428 extend on the guide surface 426 in the direction of sheet discharge and are capable of engaging with the ribs 424. The ribs 424 and 428 are configured such that a pair of ribs 428 at both sides of the paper center contact the side faces of a pair of ribs 424 at both sides of the paper center at their inner side faces.

A pair of positioning pins 430 (only one is visible) are studded on each of the right and left portions of the casing 420 in order to position the casing 420 at the preselected mounting position. Four positioning pins 432 for receiving such positioning pins 430 are formed in the apparatus body 800A. After the casing 420 has been located at the above position with the pins 430 received in the corresponding holes 432, a screw 434 is driven into the casing 420 and apparatus body 800A so as to fasten the former to the latter.

The top of the casing 420 plays the role of a stack section 436 for stacking sheets when the finisher 402 is not used.

Assume that the finisher 402 is mounted to the side of the apparatus 800. Then, after the casing 420 has been affixed to the apparatus body 800A, the conveying mechanism 418 arranged in the casing 420 conveys the sheet S driven out via the discharge section 410 to the finisher 402.

Figure 35:
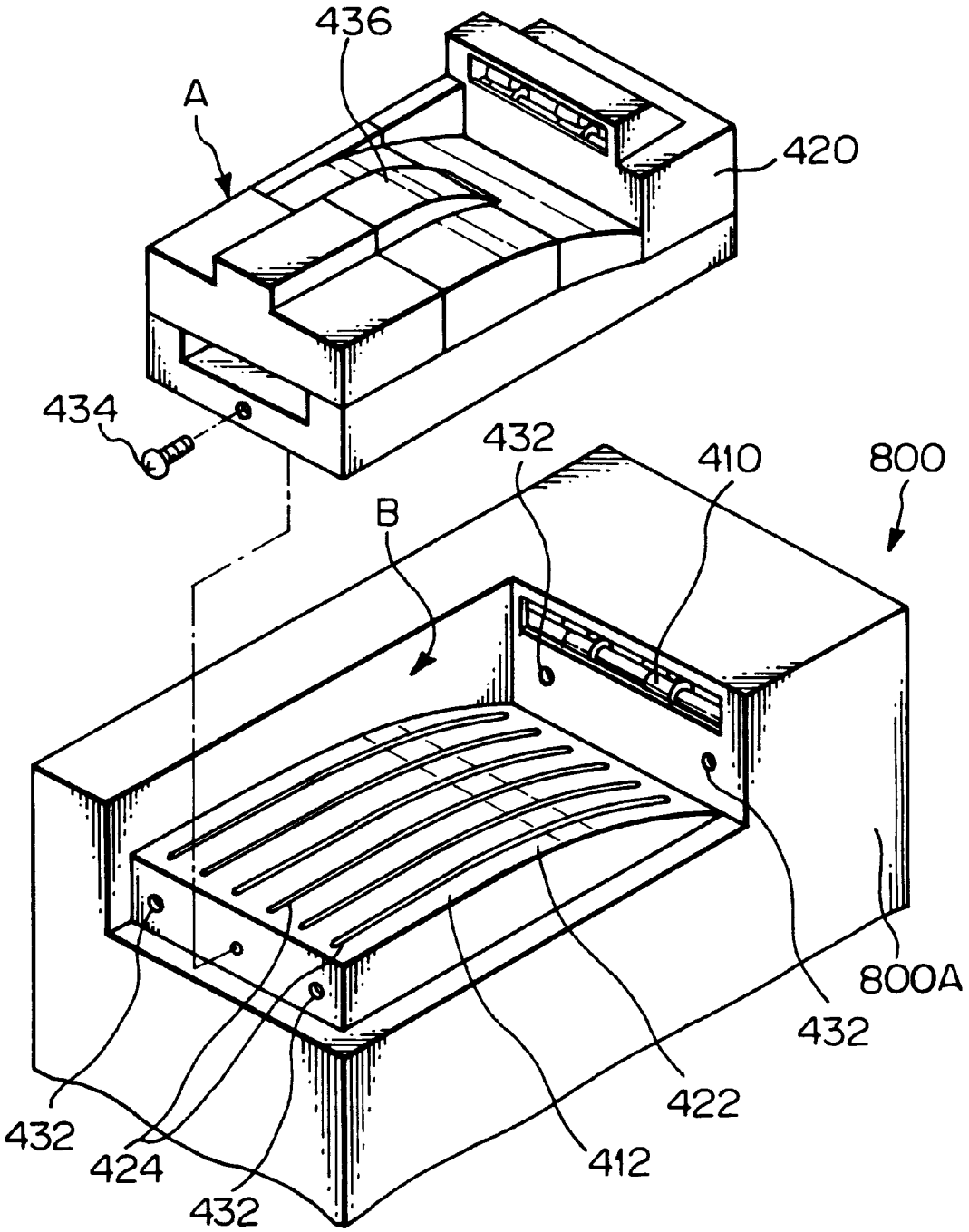
FIG. 35 is a perspective view showing an apparatus body and a casing included in the tenth embodiment and separated from each other.
Figure 37:
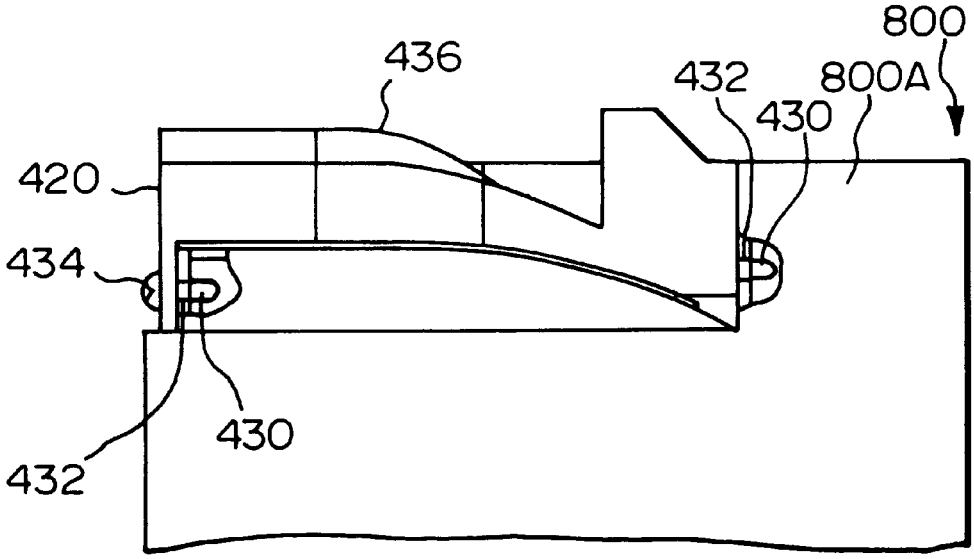
FIG. 37 is a view showing the casing fully mounted to the apparatus body.

To mount the casing 420 to the apparatus body 800A, the casing 420 is put on the stack section 412 with its rear face A, FIG. 35, contacting the rear face B, FIG. 35, of the apparatus body 800A. At this instant, the ribs 428 of the casing 420 and the ribs 424 of the stack section 412 mate with each other with their side faces contacting each other. Subsequently, the casing 420 is moved toward the discharge section 410 along the inclined surface 422. After the positioning pins 430 have been received in the holes 432, the casing 420 is fastened to the apparatus body 800A by the screw 434, as shown in FIG. 37.

When the casing 420 is moved toward the position where the pins 430 mate with the holes 432, the casing 420 move downward along the inclined surface 422 with its guide surface 426 sliding on the surface 422. Therefore, the casing 420 can be moved to the preselected position without being dislocated. In addition, because the casing 420 moves along the inclined surface 422, it can be brought to the above position by a minimum of force. The ribs 424 and 420 mating each other prevent the casing from being dislocated in the front-and-rear direction perpendicular to the direction of sheet discharge.

As described above, the tenth embodiment achieves the following unprecedented advantages.

(1) A casing accommodating a sheet conveying mechanism can be mounted to an apparatus body with a guide surface formed on the bottom thereof sliding on a top inclined surface included in a stack section. Therefore, the casing is prevented from being dislocated in the up-and-down direction during its movement. This eliminates the need for exclusive positioning parts.

(2) While the casing is moved toward a preselected position on the apparatus body, an engaging portion formed on the guide surface of the casing and extending in a direction of sheet feed engage with ribs formed on the inclined surface of the stack section. This prevents the casing from being dislocated in the direction perpendicular to the direction of sheet discharge, and also eliminates the need for exclusive positioning parts.

Various modifications will become possible for those skilled in the art after receiving the teachings of the present disclosure without departing from the scope thereof.

What is claimed is:

1. An image forming apparatus with a finisher mounted on a side thereof, comprising:

a sheet discharge section provided in an upper portion of a body of said apparatus:

a stack section for stacking a sheet driven out via said sheet discharge section:

a casing accommodating a sheet conveying mechanism, and provided in an upper portion of said stack section, and mounted to said body of said apparatus;

an inclined surface formed on a top of said stack section and inclined obliquely downward toward said sheet discharge section; and a guide surface formed on a bottom of said casing and slidable on said inclined surface when said casing is mounted to said body of said apparatus.

2. An apparatus as claimed in claim 1, further comprising:

a first set of ribs formed on said inclined surface and extending in a direction in which sheets are discharged from said sheet discharge section, said first set of ribs being engageable with said guide surface.

3. An apparatus as claimed in claim 2, wherein said guide surface comprises:

an engaging portion engageable with said first set of ribs.

4. An apparatus as claimed in claim 3, wherein said engaging portion comprises:

a second set of ribs engageable with said first set of ribs formed on said inclined surface.

5. An apparatus as claimed in claim 4, wherein said first set of ribs is configured to mate with said second set of ribs.

6. An apparatus as claimed in claim 1, wherein said inclined surface is convex.

7. An apparatus as claimed in claim 2, wherein said inclined surface is convex.

8. An apparatus as claimed in claim 3, wherein said inclined surface is convex.

9. An apparatus as claimed in claim 4, wherein said inclined surface is convex.

10. An apparatus as claimed in claim 5, wherein said inclined surface is convex.

11. An image forming apparatus with a finisher mounted on a side thereof, comprising:

sheet discharge means for discharging sheets, provided in an upper portion of a body of said apparatus;

stack means for stacking a sheet driven out via said sheet discharge means;

a casing accommodating a sheet conveying mechanism, said casing being provided in an upper portion of said stack means and mounted to said body of said apparatus;

an inclined surface formed on a top of said stack means and inclined obliquely downward toward said sheet discharge means; and guide surface means formed on a bottom of said casing, for sliding against said inclined surface when said casing is mounted to said body of said apparatus.

12. An apparatus as claimed in claim 11, further comprising:

first rib means for engaging said guide surface means, formed on said inclined surface and extending in a direction in which sheets are discharged from said sheet discharge means.

13. An apparatus as claimed in claim 12, wherein said guide surface means comprises:

engagement means for engaging said first rib means.

14. An apparatus as claimed in claim 13, wherein said engagement means comprises:

second ribs means for engaging said first rib means formed on said inclined surface.

15. An apparatus as claimed in claim 11, wherein said first ribs means includes means for mating with said second rib means.

16. An apparatus as claimed in claim 11, wherein said inclined surface is convex.

17. An apparatus as claimed in claim 12, wherein said inclined surface is convex.

18. An apparatus as claimed in claim 13, wherein said inclined surface is convex.

19. An apparatus as claimed in claim 14, wherein said inclined surface is convex.

20. An apparatus as claimed in claim 15, wherein said inclined surface is convex.

* * * * *